US011242178B2

(12) United States Patent
Choi et al.

(10) Patent No.: US 11,242,178 B2
(45) **Date of Patent: *Feb. 8, 2022**

(54) DRINK BOTTLES

(71) Applicant: CamelBak Products, LLC, Petaluma, CA (US)

(72) Inventors: Robert Choi, Ogden, UT (US); Barley A. Forsman, Cotati, CA (US); Jeremy Galten, Petaluma, CA (US)

(73) Assignee: CAMELBAK PRODUCTS, LLC, Petaluma, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/862,105

(22) Filed: Apr. 29, 2020

(65) Prior Publication Data

US 2020/0255192 A1 Aug. 13, 2020

Related U.S. Application Data

(63) Continuation of application No. 16/035,418, filed on Jul. 13, 2018, now Pat. No. 10,676,255, which is a (Continued)

(51) Int. Cl.

| | |
|---|---|
| ***B65D 47/06*** | (2006.01) |
| ***A47G 19/22*** | (2006.01) |
| ***A45F 3/20*** | (2006.01) |

(52) U.S. Cl.

CPC ..... *B65D 47/065* (2013.01); *A45F 3/20* (2013.01); *A47G 19/2266* (2013.01); *B65D 47/066* (2013.01); *A47G 19/2272* (2013.01)

(58) Field of Classification Search

CPC ... A47G 21/185; A47G 21/18; A47G 19/2211 (Continued)

(56) References Cited

U.S. PATENT DOCUMENTS 1,788,795 A 1/1931 Hoban
2,844,267 A 7/1958 Petriccione
(Continued)

FOREIGN PATENT DOCUMENTS

CN 85106703 A 5/1986
CN 1198083 A 11/1998
(Continued)

OTHER PUBLICATIONS

English-language abstract of Chinese Patent No. CN 85106703 A, European Patent Office, May 10, 1986.
(Continued)

*Primary Examiner* — Shawn M Braden
(74) *Attorney, Agent, or Firm* — Amardeep S. Grewal; Gerard M. Donovan; Reed Smith LLP

(57) ABSTRACT

Drink bottles, or drink containers with cap assemblies that include a drink spout. In some embodiments, the drink spout is pivotally coupled to a base of the cap assembly. In some embodiments, the drink spouts include mouthpieces, including self-sealing and/or bite-actuated mouthpieces. In some embodiments, the cap assembly includes a handle, which may include at least one guard for the drink spout and/or mouthpiece. In some embodiments, the drink containers include an on/off valve. In some embodiments, the dispensing spout includes a mount for the mouthpiece and/or cooperates with the cap to provide a manual on/off valve to selectively restrict flow of drink fluid from the drink container regardless of the drink spout's and/or mouthpiece's configuration. In some embodiments, the drink containers include a drink tube extending from external of the drink containers and/or an air return system.

22 Claims, 9 Drawing Sheets

Related U.S. Application Data continuation of application No. 15/287,915, filed on Oct. 7, 2016, now Pat. No. 10,023,365, which is a continuation of application No. 14/329,096, filed on Jul. 11, 2014, now Pat. No. 9,463,911, which is a continuation of application No. 12/133,954, filed on Jun. 5, 2008, now Pat. No. 8,777,048, which is a continuation of application No. 11/588,476, filed on Oct. 26, 2006, now Pat. No. 8,622,237, which is a continuation of application No. 11/313,488, filed on Dec. 20, 2005, now Pat. No. 7,533,783.

(60) Provisional application No. 60/706,700, filed on Aug. 8, 2005, provisional application No. 60/670,828, filed on Apr. 11, 2005.

(58) Field of Classification Search
USPC ..... 215/11.4, 11.5; 220/709, 707, 704, 705
See application file for complete search history.

(56) References Cited

U.S. PATENT DOCUMENTS 2,936,934 A 5/1960 Kubiliunas
3,179,301 A 4/1965 Lucht
3,181,743 A 5/1965 Libit et al.
3,283,967 A 11/1966 Akers
3,294,293 A 12/1966 Johns
3,392,887 A 7/1968 Bross
3,739,938 A 6/1973 Paz
3,972,443 A 8/1976 Albert
4,090,650 A 5/1978 Gotta
4,212,408 A 7/1980 Valenzona
4,485,963 A 12/1984 Panicci
4,607,755 A 8/1986 Andreozzi
4,836,404 A 6/1989 Coy
4,852,762 A 8/1989 Coy
4,860,934 A 8/1989 Komischke
4,925,042 A 5/1990 Chong
5,060,833 A 10/1991 Edison et al.
5,065,909 A 11/1991 Pino et al.
5,085,336 A 2/1992 Lynd
5,085,349 A 2/1992 Fawcett
5,101,991 A 4/1992 Morifuji et al.
5,125,543 A 6/1992 Rohrabacher et al.
5,203,468 A 4/1993 Hsu
5,242,079 A 9/1993 Stephens et al.
5,273,172 A 12/1993 Rossbach et al.
5,301,858 A 4/1994 Hollander
5,307,950 A 5/1994 Li
5,332,131 A 7/1994 Pehr
5,392,968 A 2/1995 Dark
5,433,353 A 7/1995 Flinn
5,433,535 A 7/1995 Hah
5,465,866 A 11/1995 Belcastro
5,518,142 A 5/1996 Lin
5,520,304 A 5/1996 Lin
5,553,726 A 9/1996 Park
5,582,315 A 12/1996 Reid
5,601,207 A 2/1997 Paczonay
5,607,087 A 3/1997 Wery et al.
5,699,933 A 12/1997 Ho et al.
5,730,336 A 3/1998 Lerner
5,755,368 A 5/1998 Bekkedahl
5,791,510 A 8/1998 Paczonay
5,806,726 A 9/1998 Ho
5,873,478 A 2/1999 Sullivan et al.
5,884,793 A 3/1999 Wang
5,897,013 A 4/1999 Manganiello
5,911,406 A 6/1999 Winefordner et al.
6,021,801 A 2/2000 Sheppard
6,032,831 A 3/2000 Gardner et al.
6,050,433 A 4/2000 Russell et al.
6,050,445 A 4/2000 Manganiello
6,059,154 A 5/2000 Bigotte et al.
6,070,767 A 6/2000 Gardner et al.
6,095,382 A 8/2000 Gross
6,116,458 A 9/2000 Dark
6,196,413 B1 3/2001 Tung
6,199,729 B1 3/2001 Drzymkowski
6,212,959 B1 4/2001 Perkins
6,264,166 B1 7/2001 Bowland et al.
6,276,560 B1 8/2001 Belcastro
6,279,772 B1 8/2001 Bowman
6,279,773 B1 8/2001 Kiyota
6,283,344 B1 9/2001 Bradley
6,290,108 B1 9/2001 Gross
6,364,168 B1 4/2002 Gardner et al.
6,390,341 B1 5/2002 Ohmi et al.
6,422,415 B1 7/2002 Manganiello
6,446,844 B1 9/2002 Gross
6,497,348 B2 12/2002 Forsman
6,513,686 B1 2/2003 Ben-Sasson
6,523,711 B1 2/2003 Hughes et al.
6,557,721 B2 5/2003 Yang
6,607,092 B2 8/2003 Manganiello et al.
6,609,624 B2 8/2003 Goto et al.
6,675,998 B2 1/2004 Forsman et al.
6,698,716 B2 3/2004 Yang
6,708,950 B2 3/2004 Christensen et al.
6,719,273 B1 4/2004 Yang
D489,978 S 5/2004 Brown
6,742,681 B1 6/2004 Yang
6,745,915 B2 6/2004 Rees
6,764,064 B2 7/2004 Sturm et al.
6,783,115 B1 8/2004 Yang
6,837,400 B2 1/2005 Leoncavallo et al.
6,854,888 B1 2/2005 Brown et al.
6,908,015 B2 6/2005 Choi et al.
6,915,961 B2 7/2005 Renz et al.
6,994,225 B2 2/2006 Hakim
7,014,077 B2 3/2006 Brown
7,032,764 B2 4/2006 Viggiano
7,048,137 B2 5/2006 Leoncavallo et al.
7,059,490 B2 6/2006 Son
7,073,688 B2 7/2006 Choi et al.
D547,607 S 7/2007 Forsman
8,701,928 B2 4/2014 Samson
2002/0033399 A1 3/2002 Manganiello et al.
2002/0040909 A1 4/2002 Goto et al.
2002/0092858 A1 7/2002 Bowman
2002/0092877 A1 7/2002 Bowman
2002/0148806 A1 10/2002 Cheng
2002/0166990 A1 11/2002 Yang
2002/0185495 A1 12/2002 Manganiello
2003/0085232 A1 5/2003 Leinenweber
2003/0102318 A1 6/2003 Lee
2003/0116573 A1 6/2003 Clark et al.
2003/0168462 A1 9/2003 Kiyota
2003/0173536 A1 9/2003 Christensen et al.
2003/0218015 A1 11/2003 Randolph et al.
2003/0222238 A1 12/2003 Getzewich et al.
2004/0000551 A1 1/2004 Flink et al.
2004/0069783 A1 4/2004 Chen
2004/0079775 A1 4/2004 Choi et al.
2004/0089301 A1 5/2004 Choi et al.
2004/0159820 A1 8/2004 Yang
2004/0164043 A1 8/2004 Hakim
2004/0217139 A1 11/2004 Roth
2004/0217187 A1 11/2004 Renz et al.
2004/0222230 A1 11/2004 Samson et al.
2005/0029271 A1 2/2005 McDonough
2005/0029313 A1 2/2005 Robins et al.
2005/0045647 A1 3/2005 Hession et al.
2005/0056610 A1 3/2005 Randolph et al.
2005/0056652 A1 3/2005 Cezeaux
2005/0072788 A1 4/2005 Lieberman et al.
2005/0072804 A1 4/2005 Brown
2005/0115966 A1 6/2005 Leoncavallo et al.
2005/0133505 A1 6/2005 Yoneoka et al.
2005/0133519 A1 6/2005 McDonough
2005/0184075 A1 8/2005 Belcastro

(56) References Cited

U.S. PATENT DOCUMENTS

| | | | |
|---|---|---|---|
| 2005/0205587 | A1 | 9/2005 | Samson et al. |
| 2005/0218242 | A1 | 10/2005 | Renz et al. |

FOREIGN PATENT DOCUMENTS

| | | | |
|---|---|---|---|
| CN | 1394186 | A | 1/2003 |
| EP | 0266067 | A1 | 5/1988 |
| EP | 1095599 | | 5/2001 |
| GB | 2279130 | A | 12/1994 |
| JP | 2002-326655 | A | 11/2002 |
| WO | WO 97/05055 | | 2/1997 |
| WO | WO 98/46106 | | 10/1998 |
| WO | WO 00/03946 | | 1/2000 |
| WO | WO 00/49922 | | 8/2000 |
| WO | WO 03/031315 | | 4/2003 |

OTHER PUBLICATIONS

English-language abstract of Chinese Patent No. CN 1198083 A, European Patent Office, Nov. 4, 1998.
English-language abstract of Japanese Patent No. 2002-326655 A, European Patent Office, Nov. 12, 2002.
English-language abstract of Chinese Patent No. CN 1394186 A, European Patent Office, Jan. 29, 2003.

Fig. 3
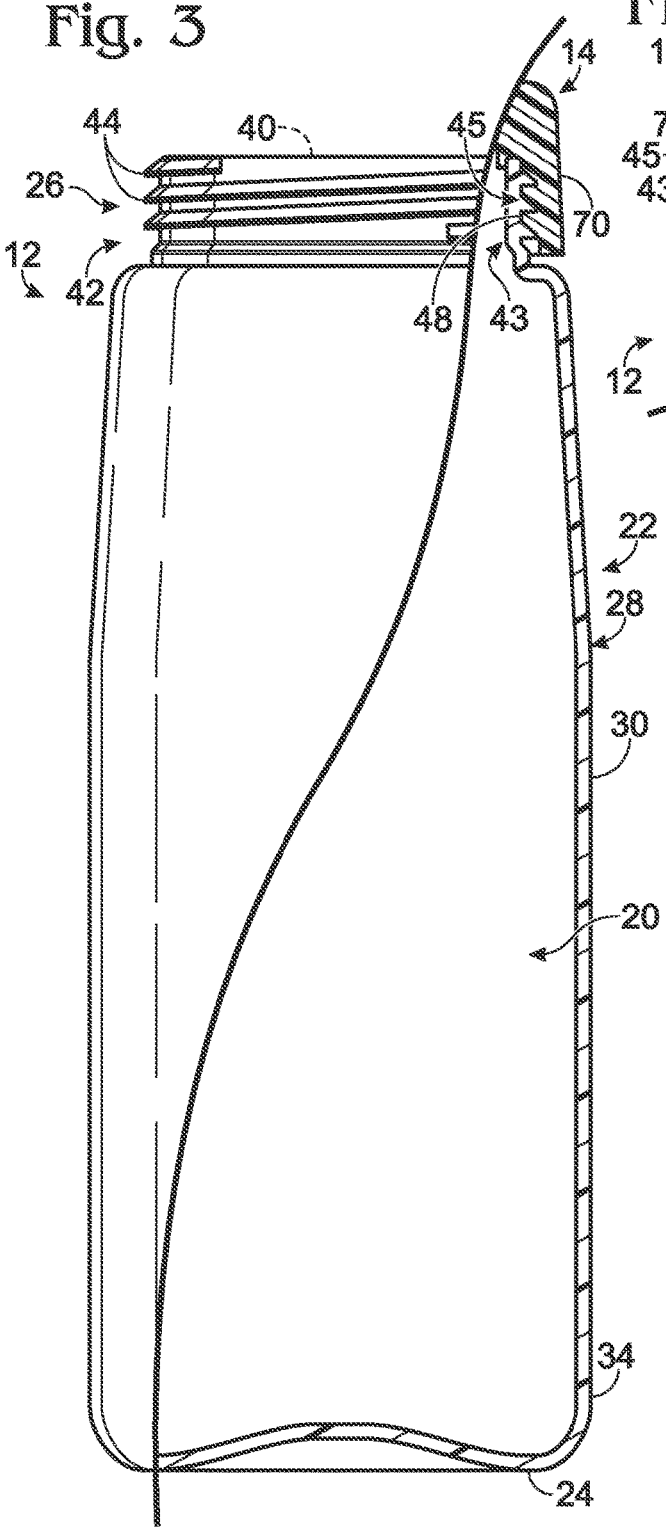
Fig. 4
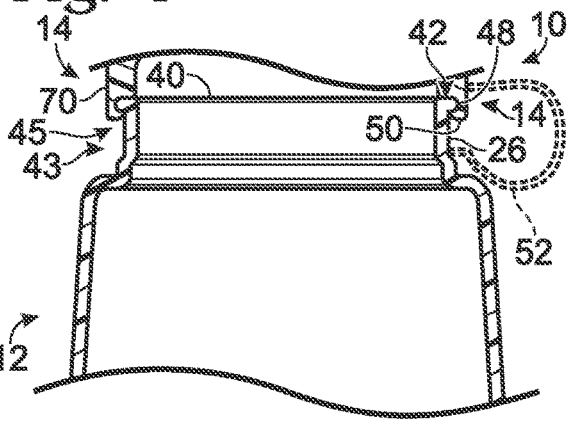
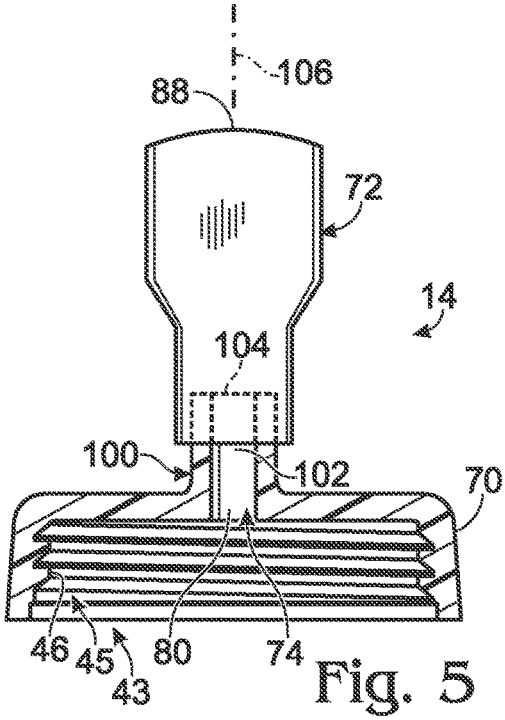
Fig. 5

Fig. 21
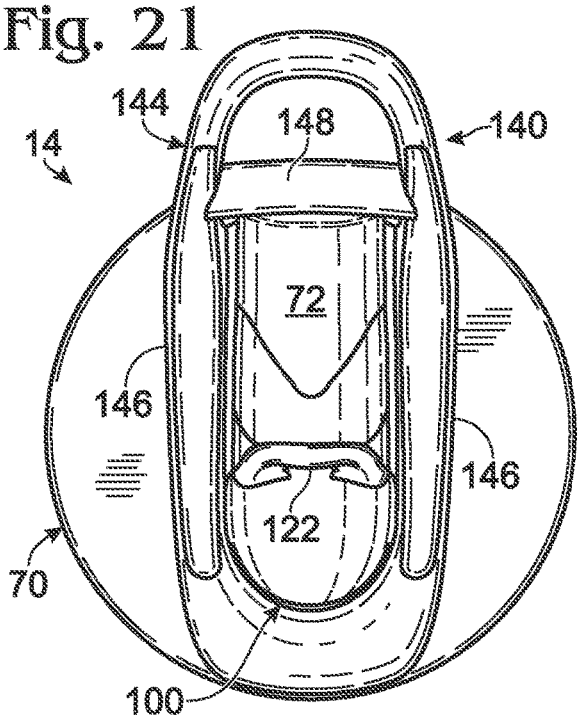
Fig. 22
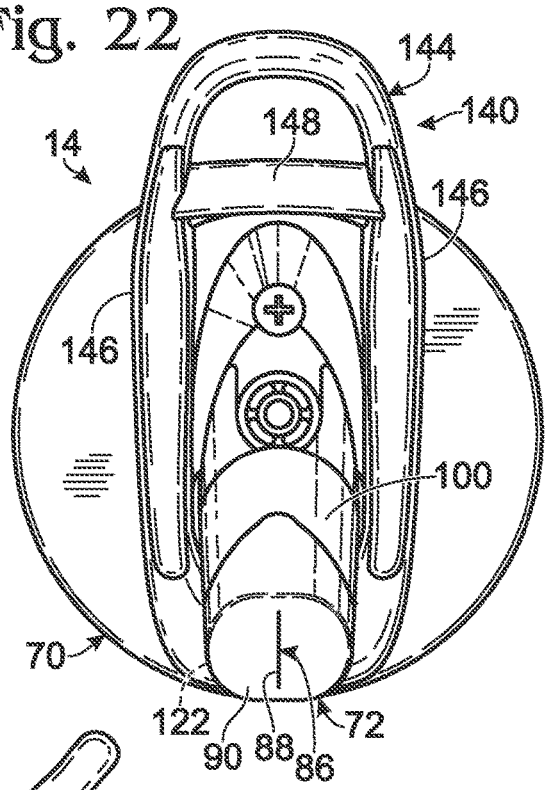
Fig. 23
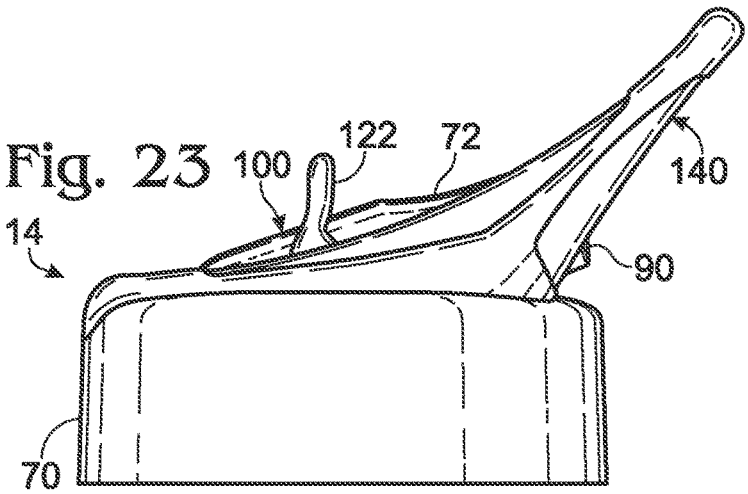
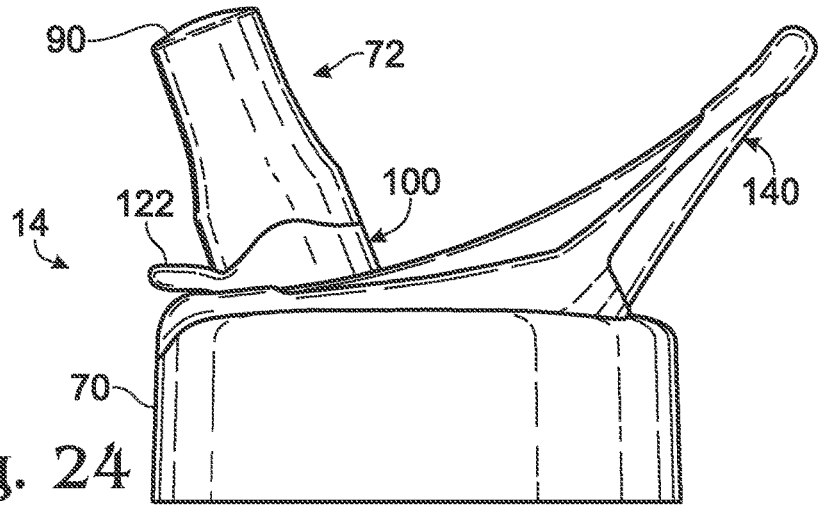
Fig. 24

DRINK BOTTLES

RELATED APPLICATIONS

The present application is a continuation of, and claims priority under 35 U.S.C. § 120 to, U.S. patent application Ser. No. 16/035,418, which was filed on Jul. 13, 2018, which claims priority to U.S. patent application Ser. No. 15/287,915, which was filed on Oct. 7, 2016, issued on Jul. 17, 2018 as U.S. Pat. No. 10,023,365, and which claims priority to U.S. patent application Ser. No. 14/329,096, which was filed on Jul. 11, 2014, issued on Oct. 11, 2016 as U.S. Pat. No. 9,463,911, and which claims priority to U.S. patent application Ser. No. 12/133,954, which was filed on Jun. 5, 2008, issued on Jul. 15, 2014 as U.S. Pat. No. 8,777,048, and which claims priority to U.S. patent application Ser. No. 11/588,476, which was filed on Oct. 26, 2006, issued on Jan. 7, 2014 as U.S. Pat. No. 8,622,237, and which claims priority to U.S. patent application Ser. No. 11/313,488, which was filed on Dec. 20, 2005, and issued on May 19, 2009 as U.S. Pat. No. 7,533,783. U.S. patent application Ser. No. 11/313,488 claims priority to U.S. Provisional Patent Application Ser. Nos. 60/670,828 and 60/706,700, which were filed on Apr. 11, 2005 and Aug. 8, 2005, respectively. The complete disclosures of the above-identified patents and patent applications are hereby incorporated by reference.

FIELD OF THE DISCLOSURE

The present disclosure relates generally to drink bottles, and more particularly to drink bottles with bite-actuated mouthpieces.

BACKGROUND OF THE DISCLOSURE

For some time people have recognized the need to stay hydrated. Conventionally, many individuals carry drink bottles that contain water or other potable beverages. These bottles are formed from plastic and include a cap. Some conventional drink bottles include a threaded or other neck from which a user drinks fluid contained in the drink bottle after removal of the cap. Some conventional drink bottles include a spout, or nozzle, from which the drink fluid may be drawn from the drink bottle without removing the cap of the drink bottle. Conventional spouts include straws and rigid spouts having an outlet through which drink fluid may flow. Other conventional drink bottles require the cap to be removed to permit drink fluid to be removed from the drink bottle.

BRIEF DESCRIPTION OF THE DRAWINGS

FIG. 3 is a fragmentary, partial cross-sectional side elevation view of a fluid container that may be used with bite-actuated drink bottles according to the present disclosure.

FIG. 4 is a fragmentary cross-sectional side elevation view of portions of another bite-actuated drink bottle according to the present disclosure.

FIG. 5 is a partial cross-sectional side elevation view of a cap assembly that may be used with bite-actuated drink bottles according to the present disclosure.

FIG. 21 is a top plan view of another suitable cap assembly for use with bite-actuated drink bottles according to the present disclosure, with the cap assembly's spout in a stowed configuration.

FIG. 22 is a top plan view of the cap assembly of FIG. 21, with the cap assembly's spout in a dispensing configuration.

FIG. 23 is a side elevation view of the cap assembly of FIG. 21.

FIG. 24 is a side elevation view of the cap assembly of FIG. 22.

DETAILED DESCRIPTION AND BEST MODE OF THE DISCLOSURE

Figure 1:
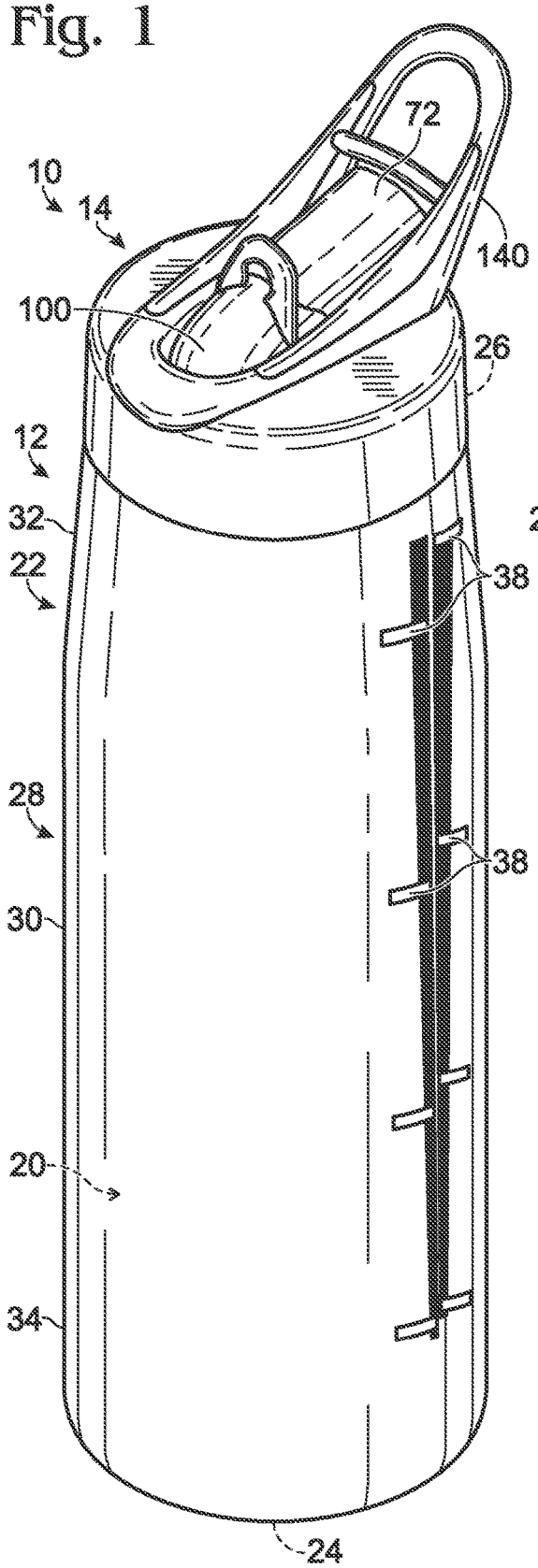
FIG. 1 is a perspective view of a bite-actuated drink bottle according to the present disclosure.
Figure 2:
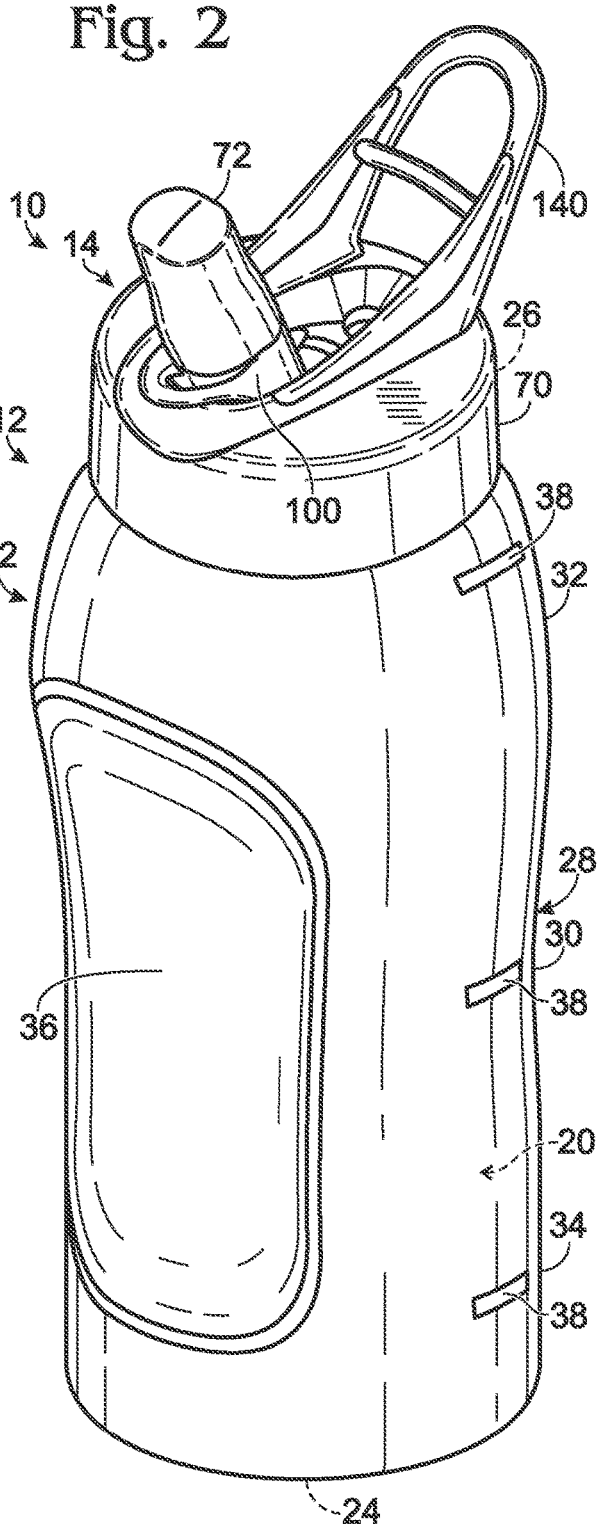
FIG. 2 is a perspective view of another bite-actuated drink bottle according to the present disclosure.

Examples of drink bottles according to the present disclosure are shown in FIGS. 1 and 2 and indicated generally at 10. Drink bottles 10 according to the present disclosure include a fluid container 12 and a cap, or cap assembly, 14 that includes a mouthpiece 72. Although referred to herein as being "drink bottles," it is within the scope of the present disclosure that the fluid container may have any suitable shape, including shapes that do not resemble conventional bottles, and may be formed from any suitable material. Accordingly, it is within the scope of the present disclosure that drink bottles 10 may additionally or alternatively be referred to as drink containers 10 and/or as beverage containers 10. As discussed in more detail herein, drink bottles 10 according to the present disclosure will typically include a free-standing fluid container 12. Drink bottles 10 according to the present disclosure will typically include a cap assembly with a base 70 that is adapted to be coupled to the fluid container and a bite-actuated mouthpiece, or valve assembly, 72 upon which a user may bite to configure the mouthpiece from a closed configuration to a dispensing configuration.

In FIGS. 1 and 2, the cap assemblies are shown including optional pivotal mounts 100 to which the mouthpieces are mounted, and optional handles 140 that extend from the cap assembly. In FIG. 2, the cap assembly is shown with the mount in a dispensing configuration in which the mouthpiece is oriented in a suitable position from which a user may draw drink fluid from the drink bottle through mouthpiece 72 when the user bites upon the mouthpiece or otherwise urges the mouthpiece from the illustrated sealed configuration to a dispensing configuration. In FIG. 1, the illustrative example of a cap assembly 14 is shown with the mount in a stowed configuration, in which the mouthpiece is positioned closer to the base of the cap than in the dispensing configuration, with the stowed configuration typically corresponding to an orientation in which the mouthpiece is not suitably positioned for a user to bite upon the mouthpiece to configure the mouthpiece to a dispensing configuration. The stowed configuration may also be referred to as a retracted configuration, and the dispensing configuration may also be referred to as an extended configuration in which the distal end, or outlet, of the mount is oriented to extend generally away from the base of the cap assembly. The various configurations referred to herein may also be selectively referred to as positions without departing from the scope of the present disclosure.

As indicated in FIGS. 1-2 and perhaps best seen in FIG. 3, fluid container 12 defines an internal compartment 20 that is sized to hold, or receive, up to a predetermined volume of potable drink fluid, or liquid. Illustrative examples of drink fluids include water, sports drinks, juices, energy drinks, and the like. Typically, container 12 will be sized to hold up to approximately two liters of drink fluid, with many embodiments of container 12 being sized to hold a maximum volume of less than two liters of drink fluid. It is within the scope of the present disclosure that container 12 may have any suitable size and shape, with illustrative, non-exclusive examples being shown in FIGS. 1-3. Illustrative, non-exclusive examples of suitable sizes (i.e., capacities of drink fluid able to be received into the fluid container at one time) for fluid container 12 include 4 oz., 6 oz., 8 oz., 10 oz., 12 oz., 16 oz., 20 oz., 24 oz., 32 oz., 36 oz., 0.5 liters, 0.7 liters, 1 liter, 1.5 liters, 6-11 oz., 12-19 oz., 19-25 oz., 12-36 oz., 25-36 oz, and 10-70 oz. (with these illustrative examples referring to fluid ounces of drink fluid that may be poured in one filling into an empty fluid container). It is within the scope of the present disclosure that containers having different sizes, including sizes that are smaller than, larger than, or within the illustrative sizes and/or ranges presented above, may be used without departing from the scope of the present disclosure.

Fluid container 12 may be formed from any suitable material or combination of materials. Non-exclusive examples of factors that may be (but are not required to be) considered when selecting material(s) for the fluid container include the durability of the material, the intended potable drink fluid, or types of drink fluids, that will be contained in the fluid container, the intended life, or period of use, of the drink bottle, whether the fluid container is intended to be refilled or otherwise reused, environmental concerns, whether the fluid container is intended to resist being collapsed during use, whether the fluid container is designed to permit a user to collapse the fluid container inwardly when dispensing fluid therefrom, or to dispense drink fluid therefrom, whether the drink container (and optionally the cap assembly) is designed to be washed in a household dishwasher, etc. Illustrative examples of materials that may be used include polycarbonate, polyethylene, polypropylene, glass, metal, and the like. In some embodiments, it may be desirable for the material(s) to be selected so that the fluid container will be transparent, or at least translucent, so that a user may see the contents of the fluid container, or at least the level of drink fluid within the fluid container, through the walls, or wall structure, of the container. In some embodiments, it may be desirable for the material(s) to be selected so that the fluid container is rigid and resists being collapsed when a user drinks from the container. In some embodiments, the material(s) may be selected so that the fluid container is designed to be collapsed (i.e., to permit opposing portions of the wall structure to be urged toward, or even into contact with, each other) during use. However, even fluid containers that are adapted to be collapsed during use, such as by a user squeezing the container, will tend to be at least semi-rigid in their construction and thereby adapted to be self-supporting. In some embodiments, the material(s) may be selected so that the fluid container is not breakable, i.e., will not shatter if dropped. Polyethylene will typically produce a collapsible fluid container that is translucent or opaque, but not transparent. Polycarbonate will typically produce a rigid, or stiff, fluid container that has a clear or glass-like appearance without the fragility of glass. Polypropylene will typically produce a fluid container that is more translucent and stiffer than polyethylene yet still able to be collapsed during use by a user squeezing the wall structure of the fluid container.

As indicated with respect to the illustrated examples of fluid containers shown in FIGS. 1-3, container 12 includes a body 22 with a base, or bottom surface, 24 and a neck 26, with the bottom surface and the neck being separated by wall structure 28. As perhaps best seen in FIG. 3, bottom surface 24 is adapted to support the drink bottle on a level surface. In other words, in the illustrative example, when the drink bottle is set upon a generally level surface, the bottom surface of the drink bottle will support the drink bottle in an upright configuration upon that surface. FIG. 3 also demonstrates that the bottom surface of the fluid container is not required to have a flat, or planar, configuration, although this configuration is within the scope of the present disclosure.

In the illustrated example shown in FIG. 2, wall structure 28 has a contoured configuration, with the central region 30 of the wall structure being tapered, or defining a portion of the internal compartment that has a reduced cross-sectional area, relative to the corresponding upper and lower regions 32 and 34 of the wall structure. For example, the central region may be shaped to facilitate easier grasping of the drink bottle by a user. It is within the scope of the present disclosure that other configurations may be utilized. For example, the body may include a handle, or passage, that extends into, or through, the drink compartment. As another illustrative, non-exclusive example, the body may include a handle that projects outwardly from the wall structure. As yet another example, the wall structure may have a cylindrical or other geometrically shaped configuration. As shown in FIG. 1, the container's wall structure 28 may have a generally cylindrical configuration. In the illustrated example, the upper region 32 of the wall structure has a tapered configuration relative to the central and lower regions 30 and 34 of the wall structure, and thereby has a smaller internal perimeter.

The cross-sectional configuration of the wall structural may be symmetrical throughout the upper, central, and lower regions, or at least one of the regions may have a cross-sectional configuration that is not symmetrical with the other regions and/or with respect to itself. For example, selectively shaping the cross-sectional configuration, or perimeter, of at least the central region may permit the drink bottle to be rotationally oriented by a user for drinking from the subsequently discussed bite-actuated valve assembly without requiring the user to look at the rotational position of the valve assembly relative to the user's hand that is holding the central region of the fluid container's wall structure. For example, and with reference to FIG. 2, shaping the wall structure to have a depression or other unsymmetrical portion 36 on the central region of the wall structure generally beneath the bite-actuated mouthpiece may permit a user to grasp and orient the bottle for drinking from the mouthpiece simply by feeling the position of the unsymmetrical portion of the wall structure. However, this is but one of many suitable configurations and is not required. In FIGS. 1 and 2, the wall structure includes gradations 38 to indicate the volume of fluid present in the container. As shown, the gradations are spaced-apart along the height of the fluid container to indicate or otherwise demarcate volumes of drink fluid. Gradations 38 provide another example of optional structure that may or may not be implemented in a particular embodiment without departing from the scope of the present disclosure.

Neck 26 provides an opening, or portal, through which drink fluid may be poured into the internal compartment of the fluid container and/or removed therefrom. Neck 26 will typically have a reduced cross-sectional area (or smaller perimeter) than the region of the fluid container from which it extends, although this configuration is not required. Neck 26 is adapted to interconnect, typically removably, with the cap assembly via any suitable mechanical interconnection, or coupling structure. In the illustrative example shown in FIG. 3, neck 26 includes a portal 40 with a coupling structure 42 that includes threads 44 that are configured to be threadingly engaged by corresponding threads 46 on the base 70 of the cap assembly to permit the cap to be screwed, or threaded, onto the neck, such as shown in FIG. 3. In the illustrative example shown in FIG. 3, the cap assembly's threads 46 provide the coupling structure 45 of the base. It is within the scope of the present disclosure that coupling assembly 43 may be used to refer collectively to the coupling structures of the base and the neck, such as threads 44 and 46.

Another example of a suitable coupling assembly 43 for interconnecting the cap assembly and the fluid container is shown in FIG. 4. As shown, the cap assembly is configured to engage the neck with a coupling assembly 43 in the form of a friction fit assembly, with neck 26 including a coupling structure 42 that includes an external lip, or ledge, 48 over which a corresponding coupling structure 45 in the form of a flange, or internal ledge, 50 of the base of the cap assembly extends to couple the cap assembly onto the neck. Cap assembly 14 and/or neck 26 may form a fluid-tight seal therebetween without requiring the inclusion of gaskets, o-rings or seal-enhancing structure. However, it is also within the scope of the present disclosure that one or more such structures may be utilized.

As discussed, cap assembly 14 is connected, and typically removably connected, to the neck of the fluid container. By "removably connected," it is meant that the cap assembly is designed, or adapted, to be repeatedly connected to and disconnected from the neck of the fluid container without destruction of the cap assembly or the neck. When properly connected to the neck, the cap assembly forms a seal with the neck of the fluid container and thereby selectively seals the internal compartment of the container to prevent drink fluid from being dispensed therefrom through opening 40 except as permitted by the cap assembly. One or more of the cap assembly and the neck may include a compressible gasket or other sealing structure to assist in providing a water-tight seal between the cap assembly and the neck when the cap assembly is properly secured on the neck. When removed or otherwise disconnected from the fluid container, the cap assembly may be retained proximate the fluid container by a tether that interconnects the cap assembly and the fluid container to retain a connection between these components when the base of the cap assembly is not coupled to the neck of the fluid container. An optional tether is schematically illustrated in FIG. 4 at 52. When present, the tether may be integrally formed with one or both of the cap assembly and the fluid container, or it may be coupled to the cap assembly and/or the fluid container via any suitable mechanism. It is also within the scope of the present disclosure that the cap assembly may not be coupled to the fluid container by a tether.

As discussed, and as somewhat schematically illustrated in FIG. 5, cap assembly 14 includes a base 70, which is adapted to interconnect with the neck of the fluid container. Cap assembly 14 further includes a mouthpiece, such as a bite-actuated mouthpiece 72, which is adapted to selectively permit drink fluid to flow therethrough when the valve assembly is deformed from its closed configuration to a dispensing, or open, configuration. Cap assembly 14 further includes, or defines, a fluid conduit 74 though which drink fluid may selectively flow from the fluid container to the mouthpiece.

As discussed, base 70 is preferably configured to be removably coupled to the neck of the fluid container to seal the portal defined by the neck of the fluid container. In other words, a user may drink directly from the fluid container through opening 40 when the cap assembly is not secured to the neck by a suitable coupling structure. When cap assembly 14 is secured to the neck, then drink fluid may not be withdrawn from fluid container 12 other than as permitted by the cap assembly, such as via bite-actuated mouthpiece 72. Base 70 forms a portion of coupling assembly 43, with the base and the neck of the fluid container cooperating to secure the base upon the neck. In FIG. 5, base 70 is shown including coupling structure 45 in the form of threads 46 that are configured to threadingly engage corresponding threads on the neck of a fluid container. As shown in FIG. 5, base 70 also includes, or defines, an inlet 80 to the fluid conduit 74 through which drink fluid is selectively drawn from the fluid container and dispensed through bite-actuated mouthpiece 72.

Figure 6:
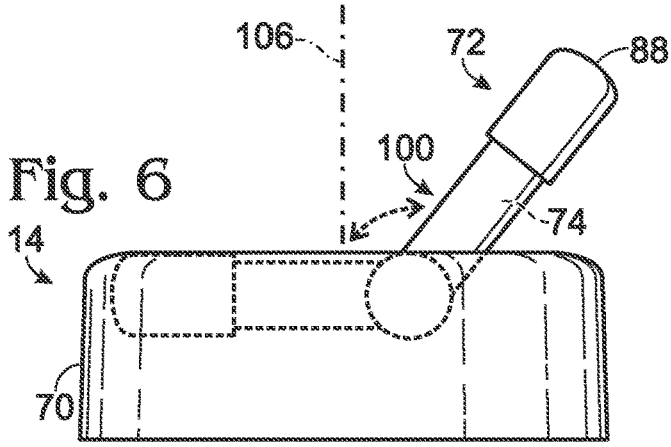
FIG. 6 is a side elevation view of another cap assembly that may be used with bite-actuated drink bottles according to the present disclosure.

As discussed, cap assembly 14 defines a fluid conduit 74 that extends from the fluid container to the bite-actuated mouthpiece so that drink fluid from container 12 may be selectively dispensed through mouthpiece 72. FIG. 5 graphically depicts that it is within the scope of the present disclosure that cap assembly 14 may include a mount 100 to which the bite-actuated mouthpiece is removably mounted, or secured, with the mount defining at least a portion of fluid conduit 74, such as which may extend through a hollow passage 102 within the mount to a distal open end region 104 of the mount. When mount 100 includes a fluid passage through which drink fluid may at least selectively flow from the internal compartment of the fluid container to the mouthpiece, the mount may be referred to as a drink spout. In the illustrated example shown in FIG. 5, mount 100 extends in a fixed orientation relative to base 70, thereby defining the orientation of the mouthpiece 72 relative to the base (and fluid container) during use of the drink bottle. In FIG. 5, the mount extends generally parallel to the central, or long, axis 106 of the cap assembly and corresponding drink bottle (i.e., straight away from the cap assembly). However, any suitable orientation may be used without departing from the scope of the present disclosure. This is graphically depicted in FIG. 6, in which the mount is shown extending at an inclined angle relative to the long, or central, axis 106 of the cap assembly and corresponding drink bottle.

It is also within the scope of the present disclosure that mount 100 may be adjustably positionable relative to the base of the cap assembly, thereby permitting the orientation of the bite-actuated mouthpiece to be adjusted within a range of positions, or configurations, that are defined at least in part by the mount. This adjustable positioning of the mouthpiece, when provided for in a particular embodiment, may permit a user to adjust the orientation of the mouthpiece to a user-selected drinking orientation. An example of an adjustably positionable mount 100 is shown in dashed lines in FIG. 6, in which the mount and attached mouthpiece are shown pivoted from the dispensing configuration shown in solid lines to a stowed configuration. In the stowed configuration, the mouthpiece is typically not positioned for being received into a user's mouth. As discussed in more detail herein, it is within the scope of the present disclosure that the cap assembly may include an optional valve or other fluid regulator that is adapted to prevent or otherwise restrict the flow of drink fluid to the mouthpiece when the mount is in a stowed configuration. In such an embodiment, when the mount is in the stowed configuration, drink fluid would be prevented from flowing from the fluid container through the mouthpiece regardless of the configuration of the mouthpiece.

Figure 7:
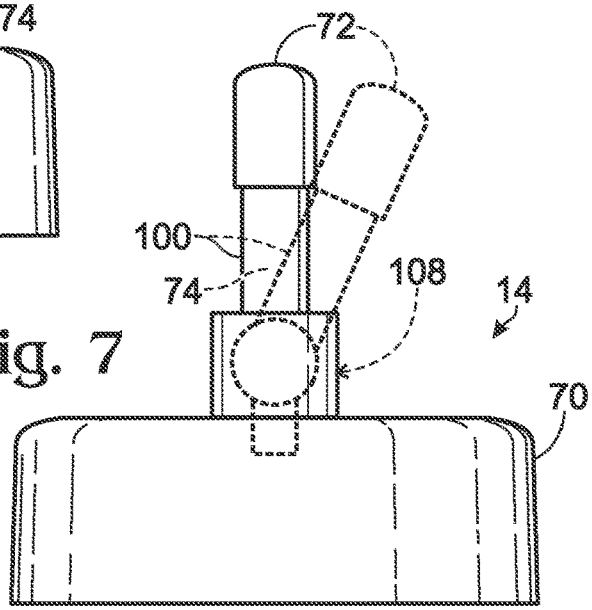
FIG. 7 is a side elevation view of another cap assembly that may be used with bite-actuated drink bottles according to the present disclosure.

Another illustrative example of a cap assembly 14 that includes a mount, or drink spout, 100 that is pivotal within a range of positions, or configurations, relative to the base of the cap assembly is shown in FIG. 7. As shown, the cap assembly includes an adjustable joint 108, which is somewhat schematically illustrated. As illustrative examples, the mouthpiece, and at least a portion of the mount, may be coupled to the base of the cap assembly by a joint (and/or valve) 108, such as may take the form of a pivotal joint, a ball joint, or other suitable structure that provides for adjusting the angular and/or rotational orientation of the mount relative to the base of the cap assembly. When the cap assembly includes such a pivotal joint 108, it is within the scope of the present disclosure that the joint may form a portion of the cap assembly's fluid conduit 74, such as with the passage of the fluid conduit extending through the joint. However, this construction is not required to all embodiments. As a variation of this structure, the mount may include a hinged or other flexible region that permits selective adjustment of the orientation of the mount's distal open end region 104 relative to the inlet of the fluid conduit.

It is within the scope of the present disclosure that the mouthpiece is non-removably, or permanently, secured to the base, mount, or other portion of the cap assembly. However, in many embodiments it may be desirable for the mouthpiece to be removably connected to the cap assembly, such as to permit the mouthpiece to be repeatedly removed, such as for cleaning or replacement, and thereafter recoupled to the mount. As non-exclusive, illustrative examples, the mouthpiece may be removably mounted onto mount 100 and/or with mount 100 being designed to be removed from base 70.

Bite-actuated mouthpiece, or valve, 72 includes at least one opening through which drink fluid may flow when the mouthpiece is in its dispensing, or open configuration. An illustrative, non-exclusive example of a suitable construction for bite-actuated mouthpiece 72 is shown in FIGS. 10-15. In the illustrated example, and perhaps best seen in FIGS. 10 and 14-15, the mouthpiece includes a dispensing outlet, or opening, 86 that is defined by a slit 88 that extends through the dispensing face 90 of the mouthpiece. It is within the scope of the present disclosure that other configurations may be used, including two or more slits, intersecting or spaced-apart slits, etc. This range of optional configurations is schematically indicated in FIG. 11, in which a pair of laterally spaced slits are shown in dashed lines at 88', and in which a second slit that intersects with slit 88 is shown in dash-dot lines at 88". The mouthpiece defines an internal chamber 110 into which drink fluid flows from the outlet, or end region, of the mount and to the opening formed by slit 88 when the mouthpiece is in a dispensing configuration. The sidewalls, or wall structure, 92 of the mouthpiece may be described as including one or more bite regions 112, which refer to opposed regions upon which a user may bite or otherwise apply compressive forces to urge the mouthpiece from its closed configuration to a dispensing configuration.

Figure 10:
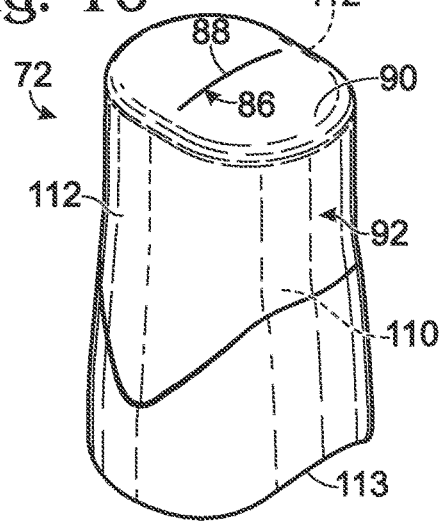
FIG. 10 is an isometric view of a bite-actuated mouthpiece that may be used with bite-actuated drink bottles according to the present disclosure.
Figure 11:
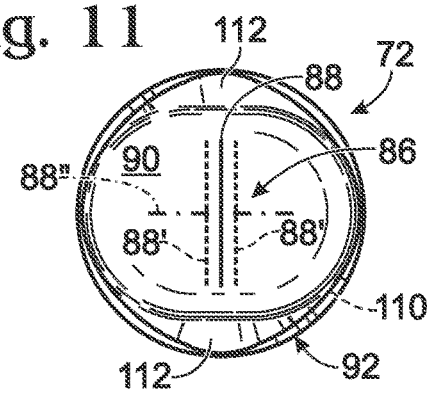
FIG. 11 is a top plan view of the mouthpiece of FIG. 10.
Figure 12:
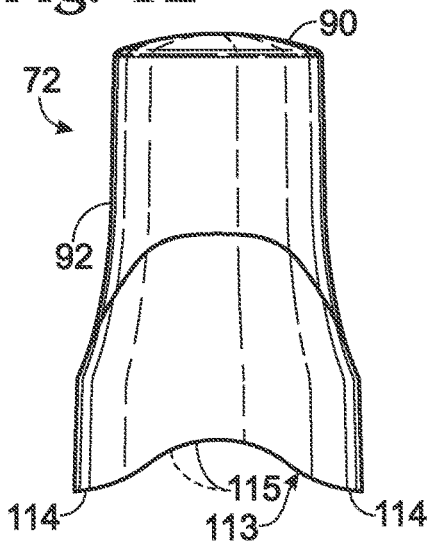
FIG. 12 is a side elevation view of the mouthpiece of FIG. 10.
Figure 13:
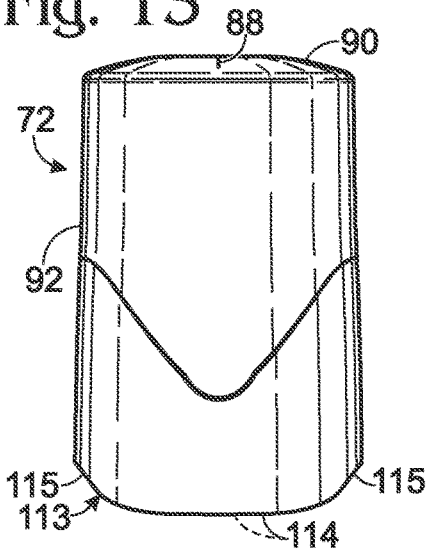
FIG. 13 is a side elevation view of the mouthpiece of FIG. 10.

As perhaps best seen in FIG. 10, the illustrated example of a mouthpiece 72 has a non-symmetrical cross-sectional configuration between opposed regions of the mouthpiece's sidewalls 92. By this it is meant that the illustrated mouthpiece has different dimensions transverse to the direction of fluid flow, depending upon whether the dimensions are measured transverse or parallel to the illustrated slit. It is within the scope of the present disclosure that other non-symmetrical or symmetrical configurations may be used. For example, mouthpiece 72 may have a circular cross-sectional configuration, amongst others.

Mouthpiece 72 is resilient and biased to its closed configuration, such as is shown in FIGS. 10-15. In use, the mouthpiece is adapted to be configured to the dispensing configuration by a user placing the mouthpiece in the user's mouth and biting upon or otherwise compressing the appropriate portions of sidewalls 92 of the mouthpiece, such as bite regions 112, to deform the mouthpiece to a position where the slit or other opening is no longer sealed and instead defines a fluid pathway through which drink fluid may flow. This is somewhat schematically depicted in FIG. 16 with another illustrative example of a suitable bite-actuated mouthpiece. As shown, the opposed lips, or sealing surfaces, 94 that define slit 88 are spread apart from each other to define opening 86, through which drink fluid may be dispensed from the drink bottle. Mouthpiece 72 may be referred to as a self-sealing valve, or valve assembly, because the mouthpiece is constructed to automatically return to its closed, or sealed, configuration when the compressive forces, such as may be applied by a user's teeth or mouth, are no longer applied to maintain the mouthpiece in its dispensing configuration. Therefore, unless forces are being exerted to the mouthpiece to deform the mouthpiece to a dispensing configuration, the mouthpiece will be in its closed, or sealed, configuration.

The illustrated example also demonstrates that the region of the mouthpiece distal the dispensing face, which may be referred to as the base, or distal, portion of the mouthpiece and which is generally indicated at 113 in FIGS. 10 and 12-15 may have (but is not required to have) a contoured configuration that does not extend at a constant distance from the dispensing face. In the illustrative, non-exclusive example shown in FIGS. 12 and 13, the base portion includes a pair of projecting regions 114 separated by a pair of concave regions 115, although this construction is not required and other irregular base configurations may be utilized without departing from the scope of the present disclosure. Having a contoured or otherwise irregular configuration, when mounting on a dispensing spout or other mount that is complimentarily configured to receive and conform to such a configuration enables the mount to restrict relative rotation of the mouthpiece thereupon due to the engagement of the distal portion 113 of the mouthpiece with the mount, such as shown by referring back to FIGS. 1 and 2. As discussed, the illustrated example is but a non-exclusive example of a suitable configuration, with it being within the scope of the present disclosure that the distal portion of the mouthpiece and/or the corresponding mount may have any suitable configuration for securing the mouthpiece upon the mount.

Additional illustrative, non-exclusive examples of suitable configurations for bite-actuated, self-sealing mouthpieces 72 for use with drink containers according to the present disclosure are shown in FIGS. 17-20. In FIGS. 17-20, the mouthpieces are shown positioned on a mount 100 that extends into a neck region 116 of the mouthpiece and terminates at an end region 104. Also shown are optional stops, or internal projections, 118 that are adapted to engage the end region 104 of the mount to define the fully inserted position of the mount within the mouthpiece. The illustrative portions of mount 100 define portions of fluid conduit 74 which extends from the end region, or outlet, 104 of the mount and into the internal chamber 110 of the mouthpiece.

Figure 14:
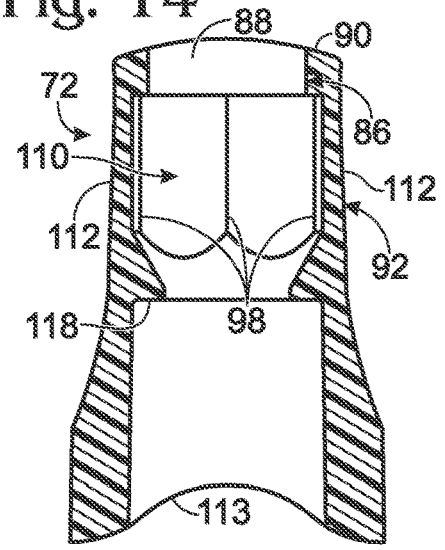
FIG. 14 is a cross-sectional view of the mouthpiece of FIG. 12.
Figure 15:
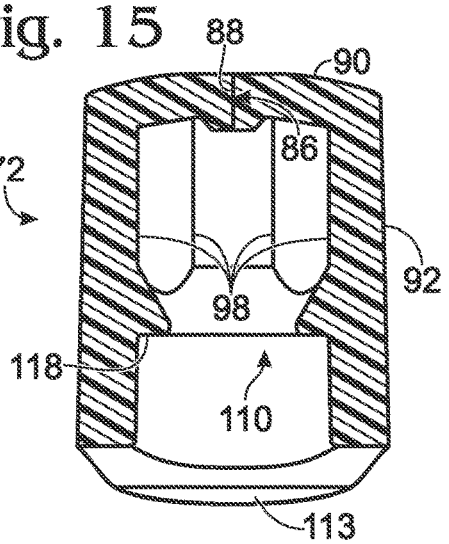
FIG. 15 is a cross-sectional view of the mouthpiece of FIG. 13.
Figure 16:
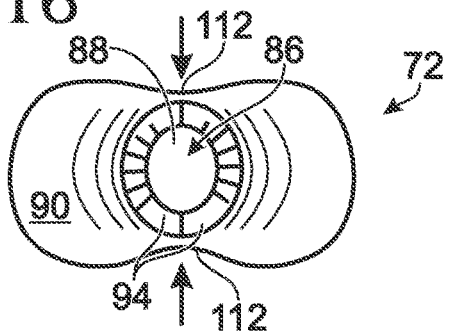
FIG. 16 is a somewhat schematic top plan view of a bite-actuated mouthpiece in a dispensing configuration.
Figure 17:
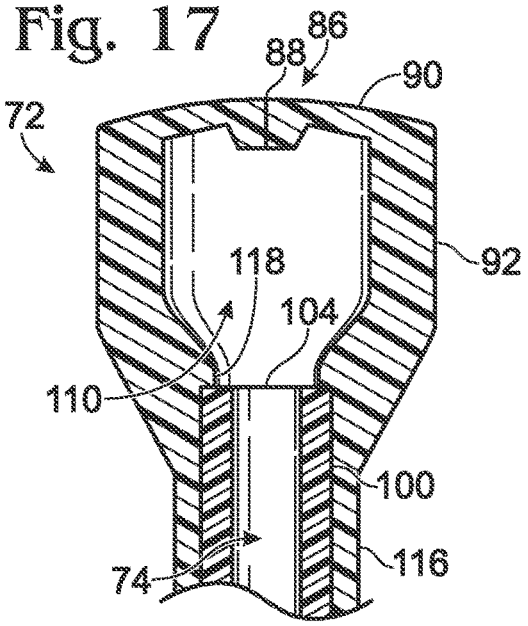
FIG. 17 is a cross-sectional view of another bite-actuated mouthpiece that may be used with bite-actuated drink bottles according to the present disclosure.
Figure 18:
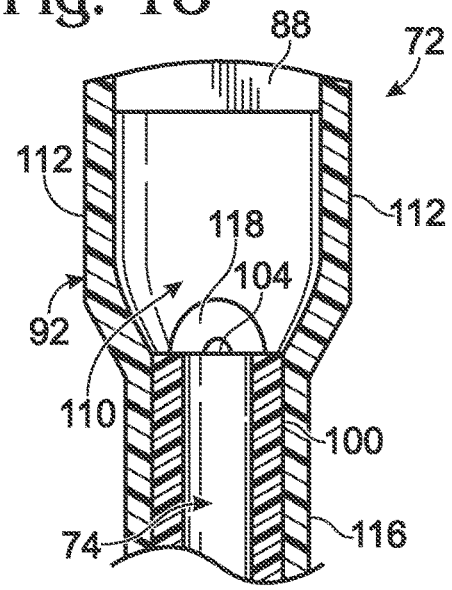
FIG. 18 is transverse cross-sectional view of the mouthpiece of FIG. 17.
Figure 19:
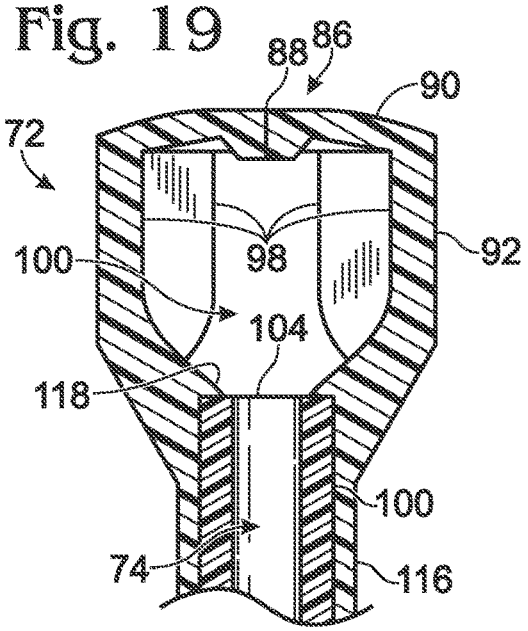
FIG. 19 is a cross-sectional view of another bite actuated mouthpiece that may be used with bite-actuated drink bottles according to the present disclosure.
Figure 20:
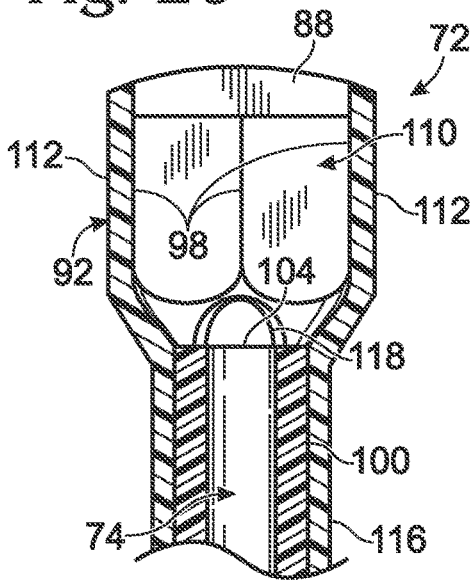
FIG. 20 is a transverse cross-sectional view of the mouthpiece of FIG. 19.

Additional illustrative examples of suitable bite-actuated mouthpieces, including external and internal constructions of which that may be selectively utilized (in whole or in part) with mouthpieces 72 according to the present disclosure are disclosed in U.S. Pat. Nos. 6,070,767 and 6,032,831, the complete disclosures of which are hereby incorporated by reference for all purposes. In the illustrated examples, mouthpiece 72 has a narrower head portion than the mouthpieces disclosed in the incorporated patents, but any of the illustrated configurations may be utilized. Similarly, the internal construction of the incorporated mouthpieces may be utilized with mouthpiece 72, such as the internal configurations for the mouthpiece's face and/or sidewalls. For example, at least FIGS. 14 and 15 illustrate that mouthpieces 72 may, but are not required to, include internal discontinuities, such as internal corners or edges, that extend along the sidewalls away from the dispensing face and which may assist in the mouthpiece deforming to its open configuration and/or returning to a sealed configuration.

In the preceding discussion, mouthpiece 72 has been described as a bite-actuated mouthpiece. As also discussed, in some embodiments, the fluid container will be formed from a material that configures, or permits, the wall structure of the fluid container to be collapsed inwardly as a user squeezes the fluid container. This intentional reduction in the internal volume of the fluid container may urge drink fluid through the fluid conduit and expel the fluid through the bite-actuated mouthpiece. It is within the scope of the present disclosure that mouthpiece 72 may be configured to permit this additional method of dispensing drink fluid from the drink bottle.

A potential benefit of the bite-actuated mouthpiece being biased to its closed configuration is that a user may position the drink bottle (and mouthpiece) to a desired drinking orientation, and even a partially or completely inverted orientation, without drink fluid being dispensed from the mouthpiece. When the user desires to drink from the positioned drink bottle, the user may bite upon the mouthpiece (and/or optionally squeeze a fluid container that is designed to be collapsed during use) to commence the flow of drink fluid through the mouthpiece to the user.

Figure 8:
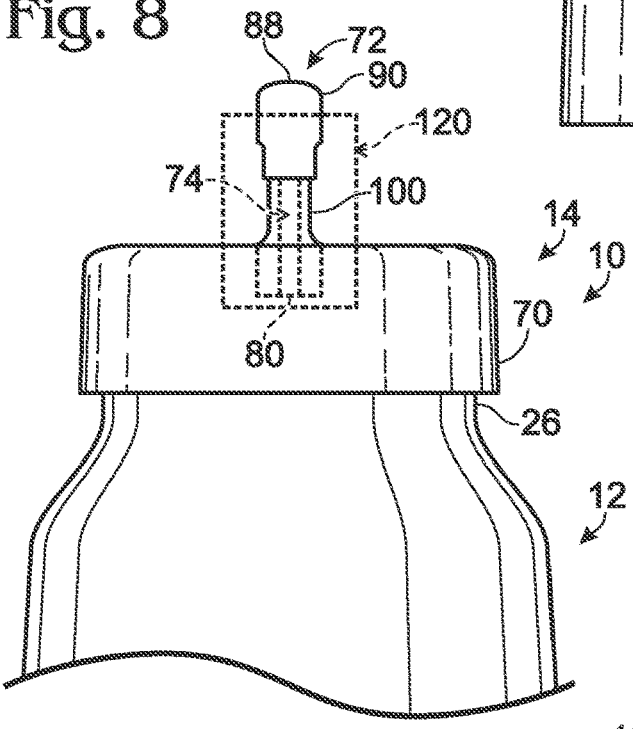
FIG. 8 is a fragmentary somewhat schematic side elevation view of portions of another bite-actuated drink bottle according to the present disclosure.

As discussed, bite-actuated mouthpiece 72 is biased to a closed, or sealed, configuration in which the opening that is formed in the dispensing face of the mouthpiece is closed and prevents drink fluid from passing therethrough. Therefore, unless the mouthpiece is reconfigured from its closed configuration to a dispensing configuration, drink fluid is prevented from being dispensed through the cap assembly's fluid conduit. In some embodiments, it may be desirable for the cap assembly to further include a flow-restricting, or on/off, valve in addition to the bite-actuated mouthpiece. For example, because the mouthpiece is designed to be configured to its dispensing configuration when lateral external forces are imparted to the mouthpiece (such as when a user bites upon or otherwise compresses the sidewalls of the mouthpiece toward each other), it is possible that external forces may be inadvertently exerted upon the mouthpiece. Should this occur, drink fluid may be dispensed through the mouthpiece. However, the inclusion of an optional manual on/off valve, which selectively restricts whether drink fluid may flow to the mouthpiece from the fluid container, may prevent this unintentional dispensing of drink fluid regardless of the configuration of the mouthpiece. A graphical example of a drink bottle according to the present disclosure that includes an on/off, or shutoff, valve and a bite-actuated mouthpiece 72 is shown in FIG. 8. In FIG. 8, the on/off valve is indicated in dashed lines at 120 to graphically represent that the on/off valve, when present, may be located at any suitable position downstream (i.e., toward the internal compartment of the fluid container) of the mouthpiece's face, and typically proximate or upstream (i.e., toward the mouthpiece's dispensing face) from the inlet of the fluid conduit 74.

The on/off valve is selectively configured between open and closed configurations independent of the configuration of the bite-actuated mouthpiece. When the on/off valve is in its closed configuration, it is adapted to obstruct at least a portion of the fluid conduit, and optionally to completely obstruct the fluid conduit, thereby preventing drink fluid from passing from the fluid container to the face of the bite-actuated mouthpiece. Therefore, when the on/off valve is in its closed configuration, drink fluid cannot be dispensed from the fluid container through the mouthpiece, regardless of the configuration of the bite-actuated mouthpiece. As such, the on/off valve may also be referred to as a shutoff valve. When the on/off valve is in its open configuration, the drink fluid is selectively dispensed from the fluid container through the mouthpiece depending upon the configuration of the bite-actuated mouthpiece.

Unlike bite-actuated mouthpiece 72, the on/off valve will typically not be biased to return automatically to a particular configuration. Instead, the on/off valve may be configured to remain in a user-selected orientation until reconfigured to a different orientation by a user. In such an embodiment, the on/off valve may be referred to as being a static valve, in that it only restricts flow of drink fluid through the fluid conduit when positively configured to do so by a user. The on/off valve may utilize any suitable actuation mechanism to selectively configure the valve between its open and closed configurations.

As an illustrative, non-exclusive example, the joint 108 illustrated in FIG. 7 may be configured to provide an on/off valve 120 when pivoting of the mount relative to the cap assembly selectively causes the fluid conduit through the cap assembly to mouthpiece 72 to be obstructed. For example, at least a portion of the fluid conduit may be obstructed as the distal end of the mount is pivoted toward the cap assembly. In some embodiments, such as when the fluid conduit extends through the joint, the degree to which the corresponding portion of the fluid conduit is obstructed may vary depending upon the degree to which the mount is pivoted or otherwise moved toward the cap assembly. In such an embodiment, the fluid conduit may not be obstructed by the joint or other on/off valve in at least one position (and optionally a sub-range of positions) within the range of positions within which the mount may be oriented relative to the cap assembly, the portion of the fluid conduit may be partially obstructed during another sub-range of the range of positions, and the portion of the fluid conduit may be completely obstructed in at least one (and optionally a third sub-range of positions) within the range of positions. It is also within the scope of the present disclosure that a similar range and sub-ranges may be provided by other embodiments of on/off valve 120. However, this construction is not required to all drink bottles according to the present disclosure.

Figure 26:
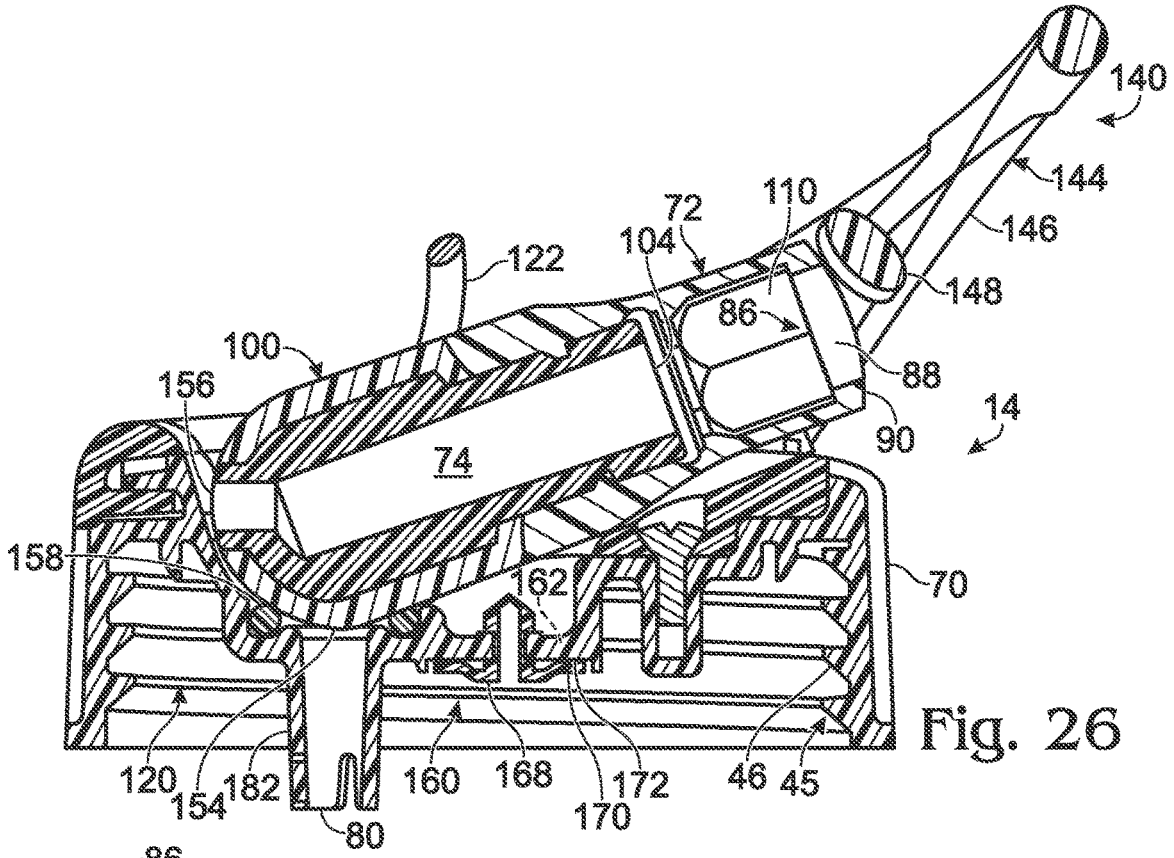
FIG. 26 is a cross-sectional side elevation view of the cap assembly of FIG. 21.
Figure 27:
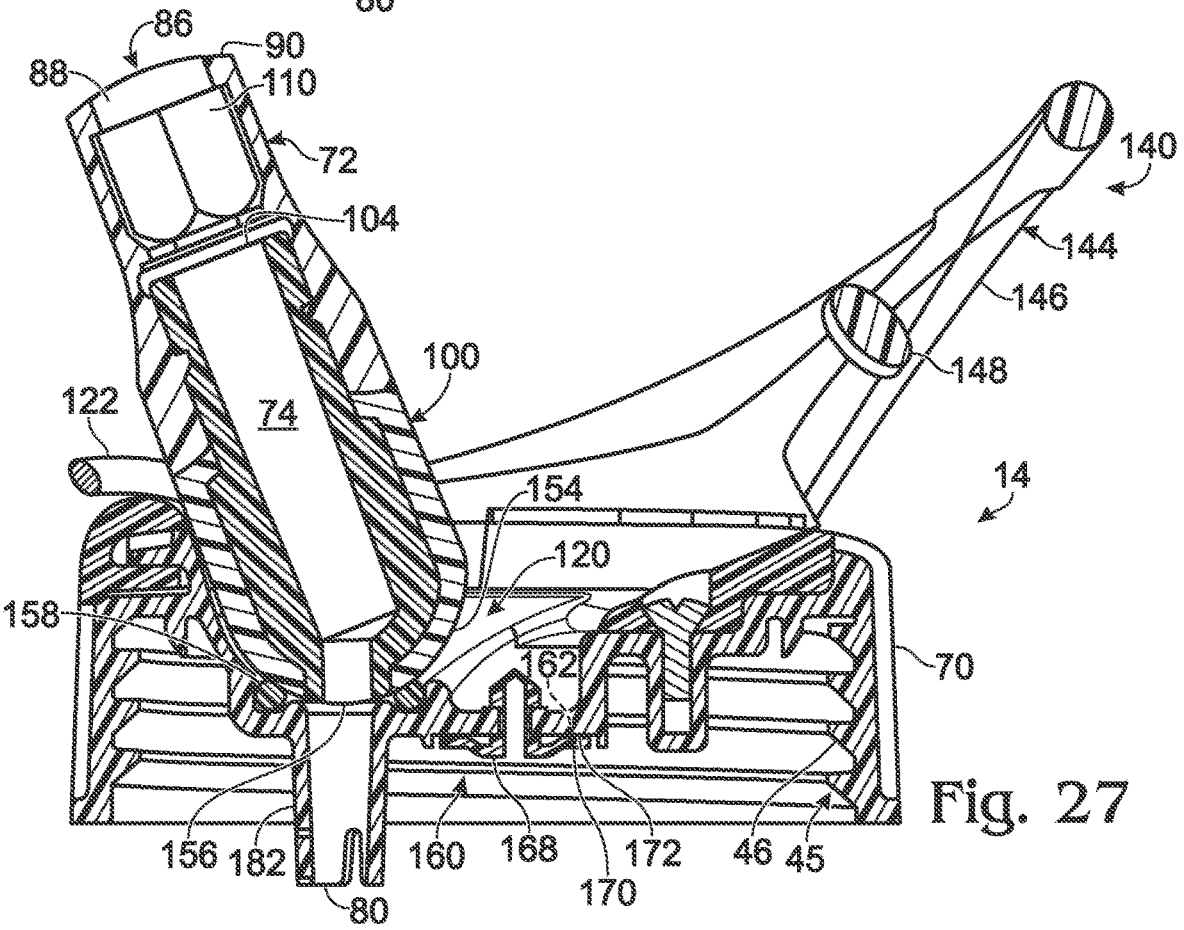
FIG. 27 is a cross-sectional side elevation view of the cap assembly of FIG. 22.

An illustrative, non-exclusive example of a suitable configuration for an on/off, or shutoff, valve is shown in FIGS. 26 and 27, in which the on/off valve is generally indicated at 120. As shown, mount 100 is pivotally coupled to base 70 of the cap assembly to selectively restrict and permit drink fluid to flow from the fluid container to the fluid conduit. In at least FIGS. 26 and 27, mount 100 may be described as providing a drink spout that is pivotally coupled to the base of the cap assembly. The drink spout is selectively pivoted between a stowed, or closed, configuration (such as shown in FIG. 26) and a dispensing, or extended, configuration (such as shown in FIG. 27), in which the drink spout is pivoted generally away from the base of the cap assembly relative to the closed configuration. In the closed configuration, the drink spout is pivoted toward or even against the base of the cap assembly relative to the dispensing configuration. In the illustrated example, the fluid conduit between the internal compartment of the drink container and the mouthpiece of the cap assembly is blocked by the drink spout when the drink spout is in its closed configuration, thereby restricting (or preventing) drink fluid from being dispensed through the drink spout regardless of the configuration of the mouthpiece when the drink spout is in the closed configuration. In the dispensing configuration, pivoting of the drink spout away from the base aligns an aperture in the drink spout to establish a continuous fluid conduit from the internal compartment to the mouthpiece.

Another example of a suitable actuation mechanism for an on/off valve 120 that may be used with drink bottles 10 according to the present disclosure is a push-pull mechanism, in which the bite-actuated mouthpiece and typically at least a portion of the mount and/or fluid conduit is urged away from a baffle or other obstruction that selectively prevents drink fluid from passing through the mount or other portion of the fluid conduit to the internal chamber of the mouthpiece. For example the push-pull mechanism may, in its closed configuration, prevent drink fluid from entering the inlet of the fluid conduit until the mouthpiece and other corresponding structure is drawn away from the obstruction. As another example, the push-pull mechanism that provides an on/off valve may selectively restrict drink fluid from passing through an intermediate portion of the fluid conduit (such as within the mount), and/or from exiting the mount into the internal compartment of the mouthpiece. In a variant of this push-pull mechanism, the obstruction is selectively pushed or otherwise urged away from the inlet or other suitable portion of the fluid conduit to permit drink fluid to flow therethrough.

Yet another illustrative example of a suitable construction for a static on/off valve 120 is a rotatable mechanism, in which a portion of the fluid conduit upstream from the internal chamber of the mouthpiece (such as the inlet, outlet, or an intermediate portion of the mount) is selectively obstructed until the mouthpiece (and typically at least a portion of the mount and/or fluid conduit) is rotated to a position in which the obstruction no longer prevents drink fluid from passing through the fluid conduit. Yet another illustrative, non-exclusive example of a suitable actuation mechanism for a static on/off valve 120 utilizes a fluid conduit having a foldable, collapsible, resiliently deformable, and/or crimpable region and suitable structure for selectively folding, flattening, resiliently deforming, and/or crimping that region of the fluid conduit to block, obstruct, or otherwise restrict the flow of drink fluid therethrough. This region may define a portion of the fluid conduit through which drink fluid may selectively flow from the inlet to the mouthpiece. An illustrative, non-exclusive example of a suitable material for such a portion of the fluid conduit is silicone or another material that does not readily take a compression set and therefore may be repeatedly folded, flattened, crimped, and the like without leaking or otherwise being permanently deformed or failing.

The schematic example of an on/off, or shutoff, valve 120 that is depicted in FIG. 8 is intended to graphically represent these and any other suitable constructions for a static on/off valve that selectively prevents drink fluid from being dispensed from the drink bottle through the opening of the mouthpiece regardless of the configuration of the mouthpiece. Additional examples are presented in the provisional patent applications that are incorporated by reference herein.

Drink bottles 10 according to the present disclosure may, but are not required to, additionally or alternatively include an air return, or pressure relief, assembly that is adapted to selectively permit air from external the drink bottle to enter the drink bottle's internal compartment other than through the dispensing opening of the mouthpiece. When present, the air return assembly is preferably positioned sufficiently away from the dispensing face of the mouthpiece that the air return valve is not obstructed when a user is drawing drink fluid from the fluid container through the opening of the mouthpiece. Especially when the fluid container has a rigid construction that is not adapted to readily collapse as drink fluid is drawn therefrom, a vacuum will tend to be drawn within the fluid container as drink fluid is withdrawn therefrom through the mouthpiece. As this vacuum, or pressure-differential, increases, it will become more difficult for a user to draw additional drink fluid through the mouthpiece until this pressure differential is reduced.

Figure 9:
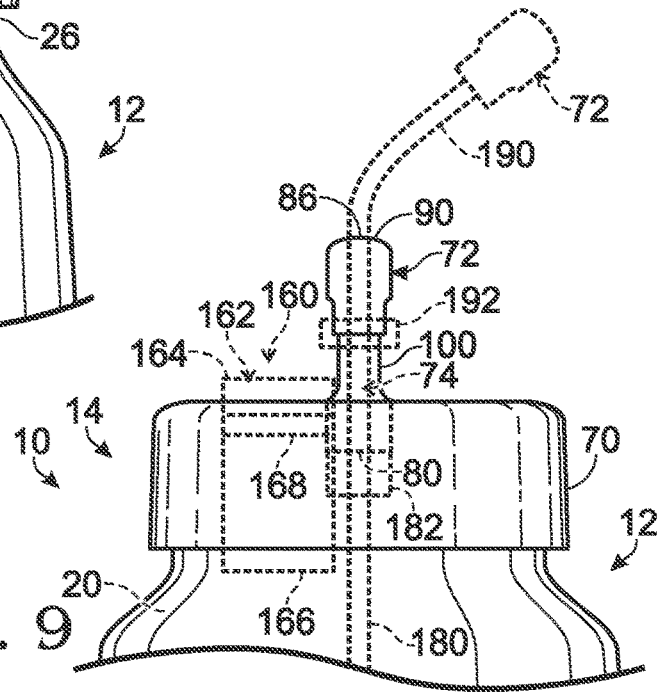
FIG. 9 is a fragmentary somewhat schematic side elevation view of portions of another bite-actuated drink bottle according to the present disclosure.

A schematic example of a drink bottle 10 according to the present disclosure that includes an air return assembly is shown in FIG. 9, with the air return assembly generally indicated at 160. Air return assembly 160 is adapted to permit air from external the drink bottle to enter the internal compartment 20 of fluid container 12 without having to pass through the drink bottle's mouthpiece 72 (or least the dispensing face 90 or opening 86 of the mouthpiece). It is within the scope of the present disclosure that the air return assembly may be implemented on the cap assembly, such as on base 70 of the cap assembly. It is also within the scope of the present disclosure that the air return assembly, when present, may be implemented on the fluid container and/or that the drink bottle may be formed without an air return assembly that is separate from the bite-actuated mouthpiece. It is also within the scope of the present disclosure that an air return valve may be integrally formed with the bite-actuated mouthpiece or that it may be separately formed from the mouthpiece. When separately formed from the mouthpiece, the air return assembly may be positioned in a spaced-apart relationship to the mouthpiece on the cap assembly, on a dispensing mount (or nozzle) 100, on the fluid container, etc.

Air return assembly 160 may define an air conduit 162 through which air may flow at least from external the drink bottle to the internal compartment of the drink container. In FIG. 9, the conduit is schematically illustrated including an inlet 164, through which air may enter the conduit from external the drink container, and an outlet 166, through which air in the conduit may pass to the interior of the drink bottle, such as to the internal compartment of the drink container.

In embodiments of drink bottles 10 that include an air return assembly 160, the air return assembly may, but is not required to, include at least one air return valve, such as is schematically illustrated in FIG. 9 at 168 and which is less schematically illustrated in the subsequently discussed FIGS. 25-29. Air return valve 168 is adapted to selectively restrict the flow of air through the air conduit from external the drink bottle and/or to restrict the flow of drink fluid through the air conduit from internal the drink bottle. Air return valve 168 is adapted to be selectively configured between a closed, or sealed, configuration in which the flow of air into the internal compartment through the air return assembly from external the drink bottle is restricted, and an open, or actuated, configuration, in which the air return valve is at least partially displaced from its sealed configuration and in which air may flow through the air return assembly, such as from external the drink bottle into the internal compartment of the fluid container. This flow of air may be through an air conduit, such as conduit 162, or may be simply through an opening in the drink bottle that is selectively obstructed by the air return valve. Air return valve 168 preferably has a relatively low actuation pressure for permitting air to be drawn from external the drink bottle into the drink bottle's internal compartment, while also having a relatively high resistance to drink fluid being able to pass through the valve from within the internal compartment. In other words, the air return valve is preferably constructed to resist fluid flow through the valve from internal the compartment. Similar to bite-actuated mouthpiece 72, the air return valve is preferably a resilient valve that is biased to a closed configuration in which the valve is sealed and thereby prevents air or other fluid from passing therethrough. As discussed, the air return valve may be designed to be configured to an actuated, or open, configuration responsive to more than a predetermined pressure differential existing between the drink bottle's internal compartment and the environment external the drink bottle.

Air return valve 168 may include any suitable structure for selectively permitting air to enter the internal compartment of the drink bottle, preferably while also restricting drink fluid from exiting the internal compartment through the air return valve. As an illustrative, non-exclusive example, the air return valve may be a pressure-differential valve that is adapted to selectively permit air to flow into the drink container's internal compartment while restricting the flow of fluid through the air conduit from the internal compartment to exterior of the drink bottle. An illustrative, non-exclusive example of a suitable construction for air return valve 168 is an umbrella, or diaphragm valve, although other suitable valves may be used, including other suitable self-sealing valves. Another illustrative example of a suitable structure is a "duck bill" configuration, in which the valve assembly projects internally into the internal compartment and includes lips that are adapted to spread apart from each other to define a passage through which air may be returned into the internal compartment of the drink bottle, but which are biased together to resist drink fluid passing from the internal compartment through the passage. Further examples include valves having one or more slits, including intersecting slits. When a self-sealing valve (i.e., a valve that is biased to a sealed configuration) is utilized, the seal may be provided by abutting surfaces of the valve itself and/or by the valve sealing against a portion of the drink bottle.

It is within the scope of the present disclosure that drink containers that include an air return assembly 160 may alternatively not include any form of physical valve that restricts the flow of fluid through the air conduit. In some embodiments, the air return assembly may include an air conduit that is obstructed on at least one of its ends (internal the fluid container or external the fluid container) when the drink bottle is not being used, such as when a pivotal dispensing nozzle is pivoted to a closed configuration. Air return assembly 160 is preferably positioned so that its air conduit is not obstructed by a user's mouth when the drink bottle is used to dispense drink fluid to a user.

FIG. 9 also graphically depicts that drink bottles 10 according to the present disclosure may, but are not required to, include an optional straw 180 that extends from the cap assembly into the fluid container, such as to (or at least proximate) the lower region of the fluid container. Straw 180 enables a user to draw drink fluid from the drink container via mouthpiece 72 without having to tip the drink bottle so that drink fluid may flow into the fluid conduit 74. For example, as the size of the fluid container increases, users may be more likely to want to draw drink fluid from the drink bottle without having to lift and tilt the drink bottle to the generally horizontal or even inverted configuration that would be used if straw 180 was not present. Straw 180 may be removably (or permanently) coupled to a corresponding mount 182 on the cap assembly, such as at or proximate the inlet 80 of fluid conduit 74. A benefit of a removable straw structure 180 is that a user may selectively attach or remove the straw structure from the cap assembly, such as depending upon the desired use of the drink bottle at a given time. As discussed, it is also within the scope of the present disclosure that the straw may be fixedly, or permanently, attached to the cap assembly. As used herein, "removably," "removably coupled," and "removably attached" refer to structures that are designed to be repeatedly connected and disconnected without destruction of the corresponding structures. Similarly, fixedly connected or permanently coupled structures refer to structures that are not designed to be separated without destruction of at least a portion of the structures and/or the mechanism that joins the structures.

FIG. 9 also illustrates that drink bottles 10 according to the present disclosure may, but are not required to, include (or be selectively used with) elongate, flexible drink tubes, or external straw structures, 190 that fluidly interconnect the bite-actuated mouthpiece with mount 100 or another suitable receiver on cap assembly 14. It is within the scope of the present disclosure that any of the drink bottles disclosed, illustrated, and/or incorporated herein may be selectively utilized with an elongate drink tube 190. A potential benefit of this optional construction is that a user may draw drink fluid from the drink bottle without having to hold the drink bottle. Although it is within the scope of the present disclosure that the drink tube may be integrated with or otherwise permanently secured to one or both of the cap assembly or the bite-actuated mouthpiece, it may be desirable for each of these components to be removably coupled to the drink tube. For example, this permits the drink bottle to be used with the mouthpiece connected directly to the cap assembly (such as to mount 100) or to be connected to the cap assembly by drink tube 190. In FIG. 9, an optional mount 192 is shown interconnecting the drink tube with mount 100, such as with the end region thereof), although it is within the scope of the present disclosure that the drink tube may be coupled directly to an end of the mount, such as by extending the corresponding end of the drink tube within or over an end of the mount. After attachment to the mount, the drink tube may optionally be described as forming an extension of the fluid conduit 74 of the drink bottle. When drink bottles according to the present disclosure include an elongate drink tube, such as tube 190, it is also within the scope of the present disclosure that the downstream assembly defined by the drink tube and mouthpiece may optionally include one or more quick-connect assemblies and/or flow-regulating devices and accessories, such as disclosed in U.S. Pat. Nos. 6,908,015, 7,073,688, and U.S. Patent Application Publication No. 2004/0089301, the complete disclosures of which are hereby incorporated by reference herein for all purposes.

The previously discussed FIGS. 7-9 schematically illustrate a variety of components and structures that may (but are not required to be) incorporated into drink bottles according to the present disclosure. It is within the scope of the present disclosure that these components and structures, when present, may have any suitable structure meeting the functional criteria set forth herein and may be implemented individually or in combination with others of these or other components and structures.

FIGS. 21-27 show a less schematic example of a suitable cap assembly 14 that may be used with drink bottles 10 according to the present disclosure. The example shown in FIGS. 21-27 includes non-exclusive examples of various ones of the previously discussed components and structures. However, it is with the scope of the present disclosure that other components and/or structures may be utilized in place of or in addition to the illustrated components and structures. Accordingly, the depicted example is not intended to require the selected examples and combination of components and structures. Instead, it is intended to provide an illustrative, non-exclusive example of a suitable construction for cap assemblies according to the present disclosure. The other components, structures, and variants thereof that are illustrated, described and/or incorporated herein may be selectively utilized with the illustrated cap assembly without departing from the scope of the present disclosure. Similarly, the illustrated cap assembly may be used with any of the drink bottles described, illustrated, and/or incorporated herein, as may the other cap assemblies and/or mouthpieces described, illustrated and/or incorporated herein.

In the example shown in FIGS. 21-27, the cap assembly includes a base 70 from which a mount, or drink spout, 100 extends. The mount is pivotally coupled to the base of the cap assembly and is selectively pivoted within a range of positions relative to the base of the cap assembly. In FIGS. 21, 23, and 26, the mount is shown in a stowed configuration, while in FIGS. 22, 24-25 and 27, the mount is shown in illustrative dispensing configurations within the range of positions. The dispensing configurations of the mount may also be described as deployed and/or ready-to-drink configurations. The cap assembly includes a bite-actuated mouthpiece 72 that is mounted on mount 100 and is in fluid communication therewith. The illustrative mouthpiece includes a dispensing face 90 having a self-sealing opening 86 through which drink fluid may be selectively dispensed when the mount and mouthpiece are both in dispensing configurations.

In the illustrative example shown in FIGS. 21-27, the mount includes an optional flange, or lever arm, 122 that projects from the mount and provides a surface that may be grasped or otherwise suitably engaged by a user, such as by a user's finger or thumb, to draw the mouthpiece and its mount from the stowed configuration toward, or to, a ready-to-drink configuration. Flange 122 may optionally be utilized with any of the other pivotal (or otherwise selectively stowable) mounts that are described, illustrated and/or incorporated herein.

The illustrative example of a cap assembly 14 shown in FIGS. 21-27 also includes a handle 140 that extends from the base of the cap assembly. Handle 140 may take any other suitable form, may have a rigid or flexible construction, and may be (but is not required to be) used with any of the other cap assemblies that are disclosed, illustrated and/or incorporated herein. When present, handle 140 may, but is not required to, define a closed perimeter, or boundary, 142 through which a lanyard, karabineer, belt, strap, user's finger, or other structure may extend to hold and/or retain the drink bottle in a selected position. It is within the scope of the present disclosure that this closed boundary is perhaps best seen in FIG. 25. The closed boundary may be defined entirely by the handle or that it may be defined by the handle and the base of the cap assembly. Regardless, the closed boundary refers to a closed perimeter around an opening through which an object may be inserted, such as to position or coupled to the drink container. Additionally or alternatively, when the drink bottle includes a tether than interconnects the cap assembly and the fluid container, the tether may also define (when the cap assembly is properly mounted on the fluid container) a (or another) closed boundary through which a strap or other securing or positioning structure may extend.

Figure 25:
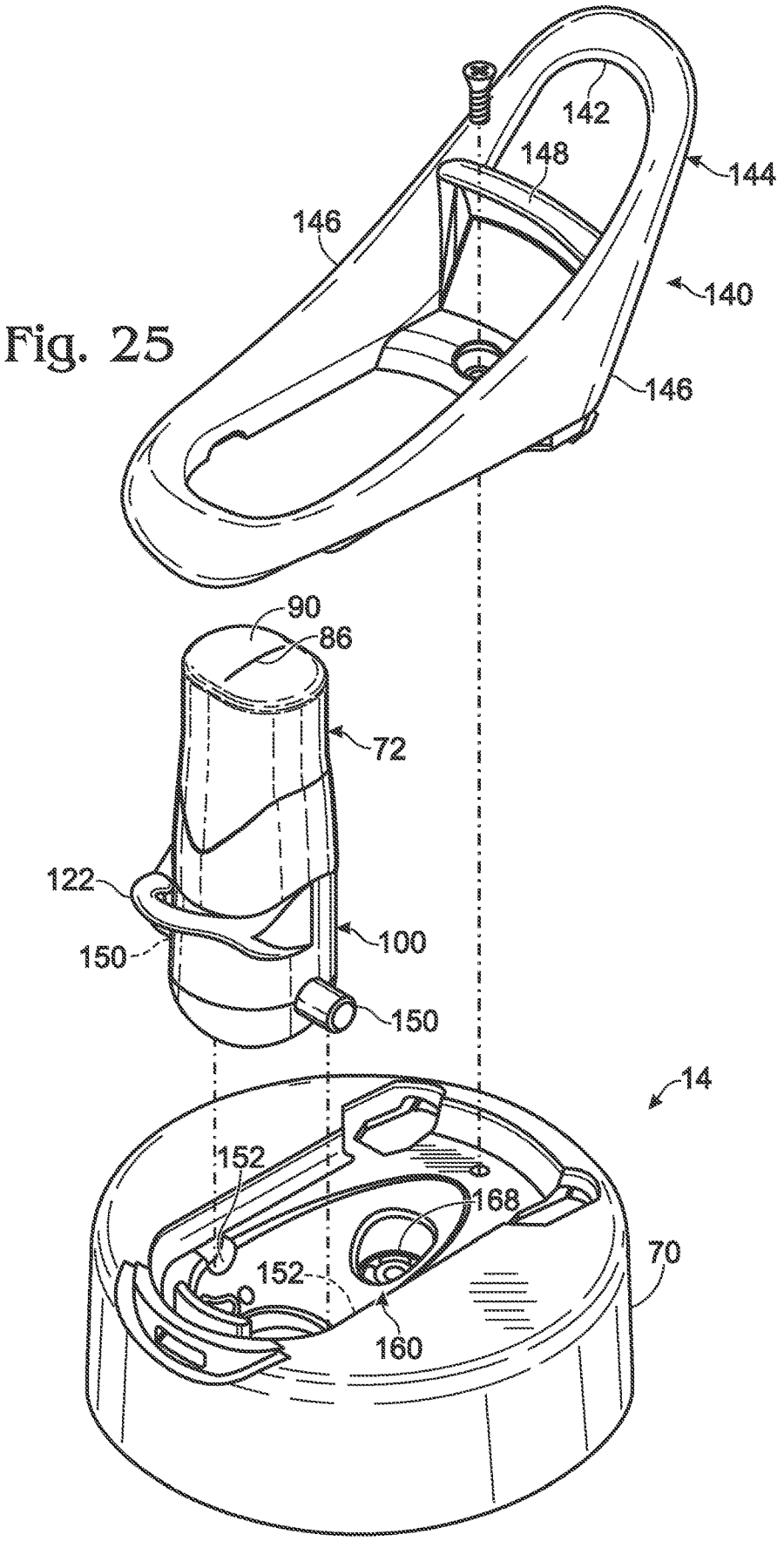
FIG. 25 is an exploded isometric view of the cap assembly of FIG. 21.

FIG. 25 also illustrates a non-exclusive example for a suitable pivotal mounting mechanism for mount 100, with the mount including lateral projections 150 that are received into sockets 152 defined by portions of the base 70 and handle 140 of the cap assembly. The projections are rotatable within the sockets, and thereby function as rotatable supports, or axles, upon which the mount and any attached mouthpiece may be pivotally moved relative to the base of the cap assembly, such as between stowed and dispensing configurations and/or otherwise within the previously discussed range of positions. This illustrative mounting configuration is intended to provide a non-exclusive example of a suitable configuration, and it is within the scope of the present disclosure that other configurations may be utilized.

In the illustrated example, and as indicated in FIGS. 21-22 and 25, the handle also provides guards 144 that are positioned to protect the bite-actuated mouthpiece from unintentional contact and/or exposure at least when the mouthpiece is in its stowed configuration. In the illustrated example, handle 140 provides a pair of lateral guards 146 that extend on opposing sides of the mouthpiece, as well as a dispensing face guard, or cover, 148 that is adapted to protect the dispensing face of the bite-actuated mouthpiece when the mouthpiece is in its stowed configuration. For example, guard 148 may provide a form of dust cover that protects the dispensing face, and thus the slit or other opening formed therein, from being contacted by dirt, grime, and other substances when the mouthpiece is in its stowed configuration. As handle 140 is itself optional and thereby not required to all embodiments of drink bottles according to the present disclosure, it follows that handle 140, when present, may be formed with only one or more of the illustrated guards, with one or more additional guards, and/or without any guards.

In FIGS. 26 and 27, the internal structure of the cap assembly shown in FIGS. 21-25 is shown in more detail. For example, the illustrated cap assembly includes a coupling structure 45 in the form of threads 46. As discussed, any other suitable coupling structures may be utilized without departing from the scope of the present disclosure. FIGS. 26 and 27 provide a graphical illustration of a pivotal mount 100 that defines a portion of fluid conduit 74 and therefore may be referred to as a drink spout through which drink fluid may selectively flow from the drink container, through an inlet 80 of the fluid conduit defined by the cap assembly, and thereafter through an outlet 104 of the mount into the internal chamber 110 of the bite-actuated mouthpiece 72. When the mouthpiece is urged to a dispensing configuration, such as by a user biting upon the mouthpiece, the drink fluid may be dispensed through the self-sealing opening 86 in the mouthpiece.

The illustrated example of a cap assembly 14 includes a manual on/off valve, or shutoff valve, 120 that is defined at least in part by the mount. As shown in FIG. 26, fluid conduit 74 is obstructed by a portion of the body 154 of the mount when the mount is in a stowed configuration. As shown with consideration of FIGS. 26 and 27, the mount's body includes an inlet 156 that is selectively aligned in fluid communication with the inlet 80 of the fluid conduit. In FIG. 26, the mount is in a stowed configuration and the fluid inlet to the mount is not aligned in fluid communication with the inlet of the fluid conduit. As such, drink fluid is prevented from flowing from the fluid container and through the fluid conduit to the mouthpiece. Therefore, drink fluid from the fluid container will not be dispensed through the fluid conduit and mouthpiece regardless of the configuration of the mouthpiece. When the mount is pivoted to a dispensing configuration, such as shown in FIG. 27, drink fluid may flow through the entire fluid conduit. FIGS. 26 and 27 include an optional gasket, or sealing member, 158. As illustrated, the gasket takes the form of a compressible o-ring, but any other suitable structure may be utilized when sealing member 158 is included in cap assembly 14.

In FIGS. 26 and 27, the inlet 80 of the fluid conduit is defined by an optional mount 182 for an internal straw that may be selectively attached to the mount. When attached, the inlet for the fluid conduit would be defined by the distal end of the straw. When mount 182 is not present, the inlet to the fluid conduit may be defined by a portion of the cap assembly beneath the mount, or optionally, by the fluid inlet to the mount itself.

FIGS. 26 and 27 also provide a graphical example of a cap assembly 14 that includes an air return assembly 160. In the illustrative, non-exclusive example, the air return assembly includes an air return valve 168 that has an umbrella valve configuration, in which the valve assembly includes an internally deflectable flap or perimeter region 170 that is biased to seal against a region 172 of the underside (or other suitable portion) of the cap assembly that contains an aperture or other passage or conduit 162 through which air may selectively flow when the air return valve is in a open, or deflected configuration.

Figure 28:
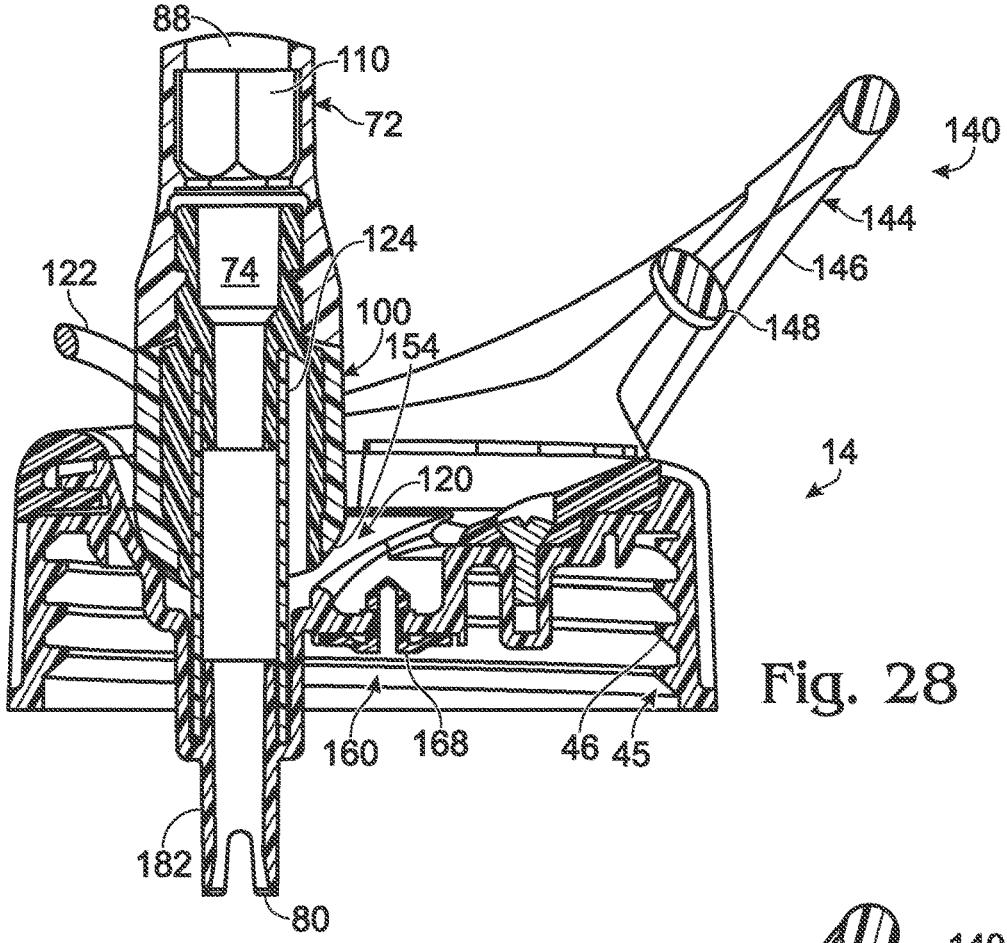
FIG. 28 is a partial cross-sectional side elevation view of another cap assembly that may be used with bite-actuated drink bottles according to the present disclosure.
Figure 29:
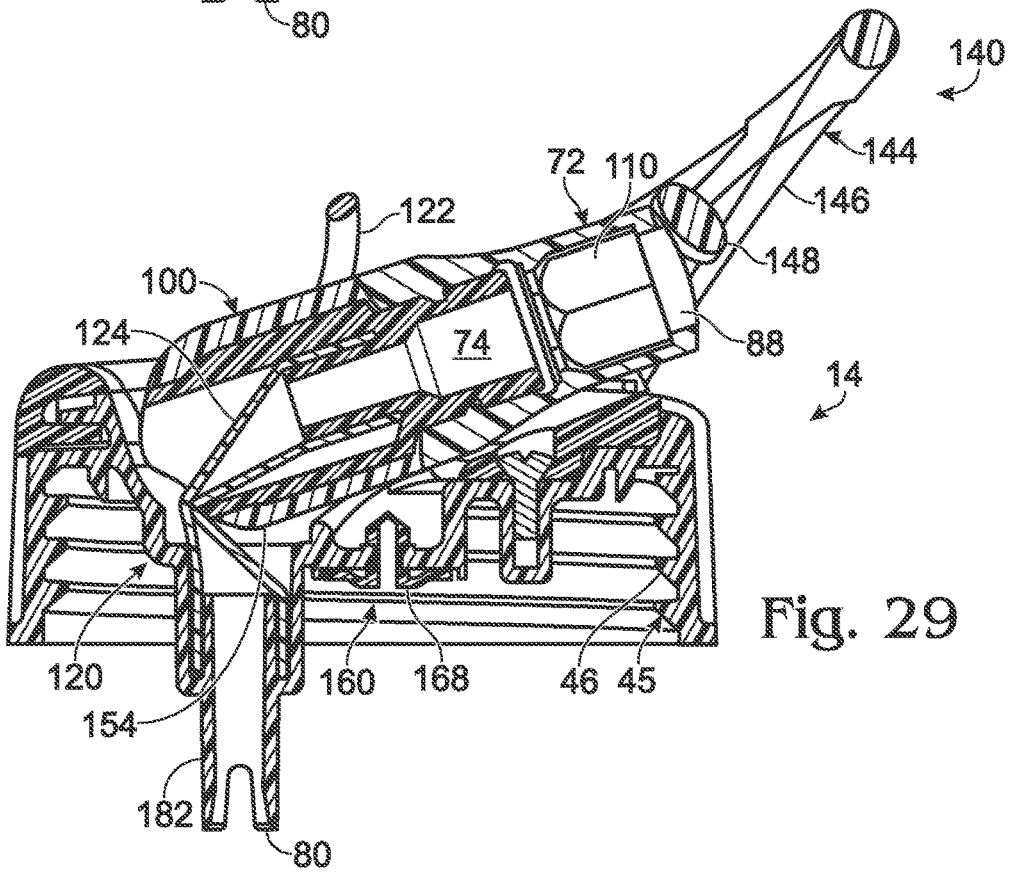
FIG. 29 is a partial cross-sectional side elevation view of the cap assembly of FIG. 28, with the spout pivoted to a stowed configuration.

FIGS. 28 and 29 generally correspond to the cap assembly shown in FIGS. 26 and 27. FIGS. 28 and 29 provide a graphical demonstration that cap assemblies 14 that include an on/off valve 120 may implement the shutoff mechanism with structure other than the structure shown in FIGS. 26 and 27. For example, in FIGS. 28 and 29, the on/off valve includes a flexible tube, or conduit 124 that in FIG. 28 fluidly interconnects the inlet 80 of the fluid conduit with the internal chamber 110 of the mouthpiece. However, when the mount is pivoted to a stowed configuration, such as shown in FIG. 29, the body 154 of the mount engages the tube and collapses or otherwise compresses or crimps the tube to obstruct the fluid conduit, thereby preventing the flow of drink fluid from the fluid container, through the fluid conduit, and out of the mouthpiece, regardless of the configuration of the mouthpiece. As the mount is pivoted from the stowed configuration shown in FIG. 29 to a dispensing configuration, such as the illustrative configuration shown in FIG. 28, the constrictive pressure applied by the body of the mount is correspondingly reduced, and a fluid flow path through the fluid conduit is reestablished.

INDUSTRIAL APPLICABILITY

The drink bottles and drink containers of the present disclosure are applicable to the hydration fields, and are specifically applicable to portable bottles and similar containers from which users may selectively drink potable drink fluid.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A drink container, comprising:

a fluid container having a neck with an opening and having an internal compartment sized to hold a volume of potable drink fluid;

a cap assembly removably coupled to the fluid container to cover the opening, wherein the cap assembly defines a fluid conduit for drink fluid to flow from the fluid container and through the cap assembly to a user, wherein the fluid conduit includes an inlet through which drink fluid from the fluid container may enter the fluid conduit, and a dispensing outlet through which drink fluid in the fluid conduit may be dispensed from the cap assembly to a user, and further wherein the cap assembly comprises:

a cap assembly base removably coupled to the neck of the fluid container, wherein the cap assembly base is configured to be selectively and repeatedly decoupled from and re-coupled to the neck of the fluid container;

a pivotal mount coupled to the cap assembly base at two joints that define a pivotal axis for pivotal movement of the pivotal mount relative to the cap assembly base;

a resilient mouthpiece coupled to the pivotal mount for pivotal movement with the pivotal mount relative to the cap assembly base;

wherein the resilient mouthpiece defines a portion of the fluid conduit, including the dispensing outlet;

wherein the resilient mouthpiece and the pivotal mount are configured to be selectively pivoted between a stowed position and a dispensing position, and further in the dispensing position, the dispensing outlet is positioned further away from the cap assembly base than when the resilient mouthpiece and the pivotal mount are in the stowed position;

wherein the resilient mouthpiece is adapted to resiliently compress responsive to compressive forces applied to the resilient mouthpiece by a user's teeth; and an on/off valve having a closed configuration, in which the on/off valve obstructs the fluid conduit to restrict drink fluid from flowing between the inlet and the dispensing outlet, and an open configuration, in which the on/off valve permits drink fluid to flow through the fluid conduit from the inlet to the dispensing outlet; wherein the on/off valve includes a flexible tube that defines a portion of the fluid conduit;

wherein when the on/off valve is in the closed configuration, the tube is crimped to obstruct the flow of drink fluid through the fluid conduit; and wherein when the on/off valve is in the open configuration, the tube is not crimped and does not obstruct the flow of drink fluid through the fluid conduit.

2. The drink container of claim 1, wherein the two joints comprise a pair of lateral projections extending from the pivotal mount that extend into a pair of sockets in the cap assembly base.

3. The drink container of claim 2, wherein the cap assembly base further comprises a handle that extends from the cap assembly base, and further wherein the handle is secured to the cap assembly base in a position that obstructs removal of the pair of lateral projections from the pair of sockets.

4. The drink container of claim 1, wherein the cap assembly includes a pair of lateral guards that extend on opposed sides of the resilient mouthpiece when the resilient mouthpiece and the pivotal mount are in the stowed position, and further wherein the cap assembly includes a dust cover extending between the pair of lateral guards and positioned to protect the dispensing outlet of the resilient mouthpiece by extending across at least a portion of the dispensing outlet of the resilient mouthpiece when the resilient mouthpiece and the pivotal mount are in the stowed position.

5. The drink container of claim 4, wherein when the resilient mouthpiece is pivoted from the stowed position to the dispensing position, the resilient mouthpiece pivots away from the dust cover.

6. The drink container of claim 4, wherein the dust cover projects above an upper surface of the cap assembly base.

7. The drink container of claim 4, wherein the cap assembly further includes a handle that extends from the cap assembly base and includes the pair of lateral guards and the dust cover.

8. The drink container of claim 1, wherein the cap assembly further comprises a handle that extends in a fixed orientation from the cap assembly base and which defines at least a portion of a closed loop with an aperture through which a user's finger may be inserted to carry the drink container.

9. The drink container of claim 1, wherein the pivotal mount further includes a projecting flange that provides a lever arm that is configured to be engaged by a user's finger to pivot the pivotal mount.

10. The drink container of claim 1, wherein the resilient mouthpiece includes projections that extend generally transverse to the portion of the fluid conduit that extends through the resilient mouthpiece, and further wherein the projections engage an end region of the pivotal mount.

11. A drink container, comprising:

a fluid container having a neck with an opening and having an internal compartment sized to hold a volume of potable drink fluid;

a cap assembly removably coupled to the fluid container to cover the opening, wherein the cap assembly defines a fluid conduit for drink fluid to flow from the fluid container and through the cap assembly to a user, wherein the fluid conduit includes an inlet through which drink fluid from the fluid container may enter the fluid conduit, and a dispensing outlet through which drink fluid in the fluid conduit may be dispensed from the cap assembly to a user, and further wherein the cap assembly comprises:

a cap assembly base removably coupled to the neck of the fluid container, wherein the cap assembly base is configured to be selectively and repeatedly decoupled from and re-coupled to the neck of the fluid container;

a pivotal mount coupled to the cap assembly base at two joints that define a pivotal axis for pivotal movement of the pivotal mount relative to the cap assembly base;

a mouthpiece disposed on the pivotal mount for pivotal movement with the pivotal mount relative to the cap assembly base;

wherein the mouthpiece defines a portion of the fluid conduit, including the dispensing outlet;

wherein the mouthpiece and the pivotal mount are configured to be selectively pivoted between a stowed position and a dispensing position, and further in the dispensing position, the dispensing outlet is positioned further away from the cap assembly base than when the mouthpiece and the pivotal mount are in the stowed position; and an on/off valve having a closed configuration, in which the on/off valve obstructs the fluid conduit to restrict drink fluid from flowing between the inlet and the dispensing outlet, and an open configuration, in which the on/off valve permits drink fluid to flow through the fluid conduit from the inlet to the dispensing outlet; wherein the on/off valve includes a flexible tube that defines a portion of the fluid conduit;

wherein when the on/off valve is in the closed configuration, the tube is crimped to obstruct the flow of drink fluid through the fluid conduit; and wherein when the on/off valve is in the open configuration, the tube is not crimped and does not obstruct the flow of drink fluid through the fluid conduit.

12. The drink container of claim 11, wherein the two joints comprise a pair of lateral projections extending from the pivotal mount that extend into a pair of sockets in the cap assembly base.

13. The drink container of claim 12, wherein the cap assembly base further comprises a handle that extends from the cap assembly base, and further wherein the handle is secured to the cap assembly base in a position that obstructs removal of the pair of lateral projections from the pair of sockets.

14. The drink container of claim 11, wherein the cap assembly includes a pair of lateral guards that extend on opposed sides of the mouthpiece when the mouthpiece and the pivotal mount are in the stowed position, and further wherein the cap assembly includes a dust cover extending between the pair of lateral guards and positioned to protect the dispensing outlet of the mouthpiece by extending across at least a portion of the dispensing outlet of the mouthpiece when the mouthpiece and the pivotal mount are in the stowed position.

15. The drink container of claim 14, wherein when the mouthpiece is pivoted from the stowed position to the dispensing position, the mouthpiece pivots away from the dust cover.

16. The drink container of claim 14, wherein the dust cover projects above an upper surface of the cap assembly base.

17. The drink container of claim 14, wherein the cap assembly further includes a handle that extends from the cap assembly base and includes the pair of lateral guards and the dust cover.

18. The drink container of claim 11, wherein the cap assembly further comprises a handle that extends in a fixed orientation from the cap assembly base and which defines at least a portion of a closed loop with an aperture through which a user's finger may be inserted to carry the drink container.

19. The drink container of claim 11, wherein the pivotal mount further includes a projecting flange that provides a lever arm that is configured to be engaged by a user's finger to pivot the pivotal mount.

20. The drink container of claim 11, wherein the mouthpiece includes projections that extend generally transverse to the portion of the fluid conduit that extends through the mouthpiece, and further wherein the projections engage an end region of the pivotal mount.

21. The drink container of claim 1, wherein each joint comprises a protrusion and a socket.

22. The drink container of claim 11, wherein each joint comprises a protrusion and a socket.

* * * * *